US008646883B2

(12) United States Patent
Marcus et al.

(10) Patent No.: US 8,646,883 B2
(45) Date of Patent: Feb. 11, 2014

(54) DROP PLACEMENT ERROR REDUCTION IN ELECTROSTATIC PRINTER

(75) Inventors: Michael A. Marcus, Honeoye, NY (US); Hrishikesh V. Panchawagh, Rochester, NY (US); Shashishekar P. Adiga, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 24 days.

(21) Appl. No.: 13/424,436

(22) Filed: Mar. 20, 2012

(65) Prior Publication Data

US 2013/0249985 A1 Sep. 26, 2013

(51) Int. Cl.
*B41J 2/07* (2006.01)

(52) U.S. Cl.
USPC ..... 347/74; 347/78

(58) Field of Classification Search
USPC ..... 347/5, 9, 10, 73–83
See application file for complete search history.

(56) References Cited

U.S. PATENT DOCUMENTS

| | | | | |
|---|---|---|---|---|
| 3,373,437 | A | 3/1968 | Sweet et al. | |
| 3,596,275 | A | 7/1971 | Sweet | |
| 3,656,171 | A | 4/1972 | Robertson | |
| 4,068,241 | A | 1/1978 | Yamada | |
| 4,613,871 | A | 9/1986 | Katerberg | |
| 6,273,559 | B1 | 8/2001 | Vago et al. | |
| 6,450,628 | B1 * | 9/2002 | Jeanmaire et al. | 347/75 |
| 6,746,108 | B1 * | 6/2004 | Jeanmaire | 347/82 |
| 7,192,121 | B2 | 3/2007 | Barbet et al. | |
| 7,712,879 | B2 | 5/2010 | Barbet | |
| 2006/0197803 | A1 | 9/2006 | Steiner | |

FOREIGN PATENT DOCUMENTS

| | | |
|---|---|---|
| EP | 0 051 448 | 5/1982 |

OTHER PUBLICATIONS

Katerberg, J. A., "Drop Charging and Deflection Using a Planar Charge Plate", 4th International Congress on Advances in Non-Impact Printing Technologies The Society for Imaging Science and Technology, Mar. 20, 1988.
Lord Rayleigh, "On the Instability of Jets," *Proc. London Math.* Soc. X (1878).
Panchawagh, H. et al., U.S. Appl. No. 13/115,434, "Ejecting Liquid Using Drop Charge and Mass", filed May 25, 2011.
Panchawagh, H. et al., U.S. Appl. No. 13/115,465, "Liquid Ejection System Including Drop Velocity Modulation", filed May 25, 2011.
Panchawagh, H. et al., U.S. Appl. No. 13/115,482, "Liquid Ejection Method Using Drop Velocity Modulation", filed May 25, 2011.
Panchawagh, H. et al., U.S. Appl. No. 13/115,421, "Liquid Ejection Using Drop Charge and Mass", filed May 25, 2011.

* cited by examiner

*Primary Examiner* — Juanita D Jackson
(74) *Attorney, Agent, or Firm* — William R. Zimmerli

(57) ABSTRACT

Drop formation devices are provided with a sequence of drop formation waveforms to modulate the liquid jets to selectively cause portions of the liquid jets to break off into print drops having a print drop volume $V_p$ and non-print drops having a non-print drop volume $V_{np}$. The print and non-print drop volumes are distinct from each other. A timing delay device shifts the timing of drop formation waveforms supplied to drop formation devices of first and second nozzle groups so that print drops from the first and second nozzle groups are not aligned relative to each other. A charging device includes a charge electrode that is positioned in the vicinity of break off of liquid jets to produce a print drop charge state on drops of volume $V_p$ and to produce a non-print drop charge state on drops of volume $V_{np}$.

12 Claims, 18 Drawing Sheets

DROP PLACEMENT ERROR REDUCTION IN ELECTROSTATIC PRINTER

CROSS REFERENCE TO RELATED APPLICATIONS

Reference is made to commonly-assigned, U.S. patent application Ser. No. 13/115,434, entitled "EJECTING LIQUID USING DROP CHARGE AND MASS", Ser. No. 13/115,465, entitled "LIQUID EJECTION SYSTEM INCLUDING DROP VELOCITY MODULATION", Ser. No. 13/115,482, entitled "LIQUID EJECTION METHOD USING DROP VELOCITY MODULATION", and Ser. No. 13/115,421, entitled "LIQUID EJECTION USING DROP CHARGE AND MASS", the disclosures of which are incorporated by reference herein in their entirety.

Reference is also made to commonly-assigned, U.S. patent application Ser. No. 13/424,426, entitled "DROP PLACEMENT ERROR REDUCTION IN ELECTROSTATIC PRINTER", the disclosure of which is incorporated by reference herein in its entirety.

FIELD OF THE INVENTION

This invention relates generally to the field of digitally controlled printing systems, and in particular to continuous printing systems in which a liquid stream breaks into drops some of which are electrostatically deflected.

BACKGROUND OF THE INVENTION

Ink jet printing has become recognized as a prominent contender in the digitally controlled, electronic printing arena because, e.g., of its non-impact, low-noise characteristics, its use of plain paper and its avoidance of toner transfer and fixing. Ink jet printing mechanisms can be categorized by technology as either drop on demand ink jet (DOD) or continuous ink jet (CIJ).

The first technology, "drop-on-demand" ink jet printing, provides ink drops that impact upon a recording surface by using a pressurization actuator (thermal, piezoelectric, etc.). One commonly practiced drop-on-demand technology uses thermal actuation to eject ink drops from a nozzle. A heater, located at or near the nozzle, heats the ink sufficiently to boil, forming a vapor bubble that creates enough internal pressure to eject an ink drop. This form of inkjet is commonly termed "thermal ink jet (TIJ)."

The second technology commonly referred to as "continuous" ink jet (CIJ) printing, uses a pressurized ink source to produce a continuous liquid jet stream of ink by forcing ink, under pressure, through a nozzle. The stream of ink may be perturbed in a manner such that the liquid jet breaks up into drops of ink in a predictable manner. Printing occurs through the selective deflecting and catching of undesired ink drops. Various approaches for selectively deflecting drops have been developed including the use of electrostatic deflection, air deflection and thermal deflection mechanisms.

In a first electrostatic deflection based CIJ approach, the liquid jet stream is perturbed in some fashion causing it to break up into uniformly sized drops at a nominally constant distance, the break-off length, from the nozzle. A charging electrode structure is positioned at the nominally constant break-off location so as to induce an input image data dependent amount of electrical charge on the drop at the moment of break-off. The charged drops are then directed through a fixed electrostatic field region causing each droplet to deflect by an amount dependent upon its charge to mass ratio. The charge levels established at the break-off point cause drops to travel to a specific location on a recording media or to a gutter, commonly called a catcher, for collection and recirculation. This approach is disclosed by R. Sweet in U.S. Pat. No. 3,596,275 issued Jul. 27, 1971, Sweet '275 hereinafter. The CIJ apparatus disclosed by Sweet '275 consisted of a single jet, i.e. a single drop generation liquid chamber and a single nozzle structure. A disclosure of a multi jet CIJ printhead version utilizing this approach has also been made by Sweet et al. in U.S. Pat. No. 3,373,437 issued Mar. 12, 1968, Sweet '437 hereinafter. Sweet '437 discloses a CIJ printhead having a common drop generator chamber that communicates with a row (linear array) of drop emitting nozzles each with its own charging electrode. This approach requires that each nozzle have its own charging electrode, with each of the individual electrodes being supplied with an electric waveform that depends on the image data to be printed.

One known problem with these conventional CIJ printers is variation in the charge on the drops caused by the image data-dependent electrostatic fields from adjacent electrodes associated with neighboring jets. These input image data dependent variations are referred as electrostatic crosstalk. Such electrostatic crosstalk can produce visible artifacts in the printed image. Katerberg disclosed a method to reduce or eliminate the visible artifacts produced by the electrostatic crosstalk interactions by providing guard gutter drops between adjacent print drops across the jet array in U.S. Pat. No. 4,613,871. However, the presence of electrostatic crosstalk from neighboring electrodes limits the minimum spacing between adjacent electrodes and therefore resolution of the printed image.

Thus, the requirement for individually addressable charge electrodes in traditional electrostatic CIJ printers places limits on the fundamental nozzle spacing and therefore on the resolution of the printing system. A number of alternative methods have been disclosed to overcome the limitation on nozzle spacing by use of an array of individually addressable nozzles in a nozzle array and one or more common charge electrodes at constant potentials. One method uses control of the jet breakoff length as disclosed by Vago et al. in U.S. Pat. No. 6,273,559 issued Aug. 14, 2001, Vago '559 hereinafter. Vago '559 discloses a binary CIJ technique in which electrically conducting ink is pressurized and discharged through a calibrated nozzle and the liquid ink jets formed are stimulated to breakoff at two distinct breakoff distances which differ by less than the wavelength $\lambda$ of the jet defined as the distance between successive ink drops or ink nodes in the liquid jet. Two sets of closely spaced electrodes with different applied DC electric potentials are positioned just downstream of the nozzle adjacent to the two breakoff locations and provide distinct charge levels to the relatively short breakoff length drops and the relatively long breakoff length drops as they are formed. This results in differential deflection between drops having the two distinct breakoff lengths when placed in a uniform electric field region. Limiting the breakoff length locations difference to less than $\lambda$ restricts the stimulation amplitudes difference that must be used to a small amount. For a printhead that has only a single jet, it is quite easy to adjust the position of the electrodes, the voltages on the charging electrodes, and print and non-print stimulation amplitudes to produce the desired separation of print and non-print droplets. However, in a printhead having an array of nozzles part tolerances can make this quite difficult. The need to have a high electric field gradient in the droplet breakoff region also causes the drop selection system to be sensitive to slight variations in charging electrode flatness, electrode thicknesses, and component spacings that can all produce variations in the electric field strength and the electric field gradient at the droplet breakoff region for the different liquid jets in the array. In addition, the droplet generator and the associated stimulation devices may not be perfectly uniform down the nozzle array, and may require different stimulation amplitudes from nozzle to nozzle to produce particular breakoff lengths. These problems are compounded by ink properties that drift over time, and thermal expansion that can cause the charging electrodes to shift and warp with temperature. In such systems extra control complexity is required to adjust the print and non-print stimulation amplitudes from nozzle to nozzle to ensure the desired separation of print and non-print droplets.

B. Barbet and P. Henon also disclose utilizing breakoff length variation to control printing in U.S. Pat. No. 7,192,121 issued Mar. 20, 2007 (Barbet '121 hereinafter). Barbet '121 addresses some of the issues by increasing the difference in the breakoff lengths between print and non-print drops. T. Yamada disclosed a method of printing using a charge electrode at constant potential based on drop volume in U.S. Pat. No. 4,068,241. B. Barbet in U.S. Pat. No. 7,712,879 disclosed an electrostatic charging and deflection mechanism based on breakoff length and drop size using common charge electrodes at constant potentials.

These drop control systems use a charging electrode that is held at a fixed electrical potential relative to the jets in conjunction with image data dependent breakoff lengths. As they employ a charging electrode that is common to the array of nozzles, print drops are not affected by electrostatic crosstalk due to the image dependent voltage on charging electrodes associated with neighboring drops. These drop control systems however do produce print drops that are charged, albeit at a magnitude that is below that of the catch drops. The print drop charge can result in electrostatic interactions between neighboring or nearby print drops which cause alterations of drop trajectories and result in drop placement errors and degraded print quality on the recording media. As the packing density of nozzles in a print head increases to provide higher print resolution, the electrostatic interactions between neighboring or nearby print drops increase causing larger alterations in drop trajectories.

As such, there is an ongoing need to provide a high print resolution continuous inkjet printing system that prints with selected drops from an array of nozzles without the print defects of these drop control systems.

SUMMARY OF THE INVENTION

It is an object of the invention to minimize drop placement errors in an electrostatic deflection based ink jet printer caused by electrostatic interactions between adjacent print drops. A second object of this invention is to increase the print margin defined as the separation between the print drop and gutter drop trajectories.

Image data dependent control of drop formation breakoff length at each of the liquid jets in a nozzle array and a common charge electrode having a constant electrical potential are provided by the present invention. Drop formation is controlled to create sequences of one or more print drops having a breakoff length $L_p$ and sequences of one or more non-print drops having a distinct breakoff length $L_{np}$ in response to the input image data. The nozzle array is made up of a plurality of nozzles being arranged into a first group and a second group of interleaved nozzles. A timing delay device is used to shift the timing of the drop formation waveforms supplied to the drop formation devices of the first group of nozzles relative to the drop formation waveforms supplied to the drop formation devices of the second group of nozzles. This causes print drops formed from nozzles of the first group and the print drops formed from nozzles of the second group to not be aligned relative to each other along the nozzle array direction. The position of the charge electrode relative to the vicinity of the breakoff length $L_p$ and breakoff length $L_{np}$ result in a difference in electric field strength at the two breakoff lengths thus inducing different amounts of charge on print drops and on non-print drops. As the drops break off from the liquid jets a print drop charge state is produced on the print drops and a non-print drop charge state is produced on the non-print drops which are substantially different from each other. A deflection device is then utilized to separate the paths of print and non-print drops. A catcher then intercepts non-print drops while allowing print drops to travel along a path towards a recording media.

The present invention improves CIJ printing by increasing the distance between adjacent print drops in neighboring nozzles thereby decreasing drop to drop electrostatic interactions, thus resulting in improved drop placement accuracy over previous CIJ printing systems. The present invention also reduces the complexity of control of signals sent to stimulation devices associated with nozzles of the nozzle array. This helps to reduce the complexity of charge electrode structures and increase spacing between the charge electrode structures and the nozzles. The present invention also allows for longer throw distances by lowering the electrostatic interactions between adjacent print drops.

According to one aspect of the invention, a method of printing includes providing liquid under pressure sufficient to eject liquid jets through a plurality of nozzles of a liquid chamber. The plurality of nozzles is disposed along a nozzle array direction. The plurality of nozzles is arranged into a first group and second group in which the nozzles of the first group and second group are interleaved such that a nozzle of the first group is positioned between adjacent nozzles of the second group and a nozzle of the second group is positioned between adjacent nozzles of the first group. A drop formation device is associated with each of the plurality of nozzles. Input image data is provided. Each of the drop formation devices is provided with a sequence of drop formation waveforms to modulate the liquid jets to selectively cause portions of the liquid jets to break off into streams of one or more print drops having a print drop volume $V_p$ and one or more non-print drops having a non-print drop volume $V_{np}$ where the print drop volume and the non-print drop volume are distinct from each other in response to the input image data. A timing delay device is provided to shift the timing of the drop formation waveforms supplied to the drop formation devices of nozzles of one of the first group and the second group so that the print drops formed from nozzles of the first group and the print drops formed from nozzles of the second group are not aligned relative to each other along the nozzle array direction. A charging device includes a first common charge electrode associated with the liquid jets formed from both the nozzles of the first group and the nozzles of the second group and a source of constant electrical potential between the first charge electrode and the liquid jets. The first common charge electrode is positioned relative to the vicinity of break off of liquid jets to produce a print drop charge state on drops of volume $V_p$ and to produce a non-print drop charge state on drops of volume $V_{np}$ which is substantially different from the print drop charge state. A deflection device causes print drops having the print drop charge state and non-print drop having the non-print drop charge state to travel along different paths using the deflection device. A catcher intercepts non-print drops while allowing print drops to continue to travel along a path toward a recording media.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

Figure 1:
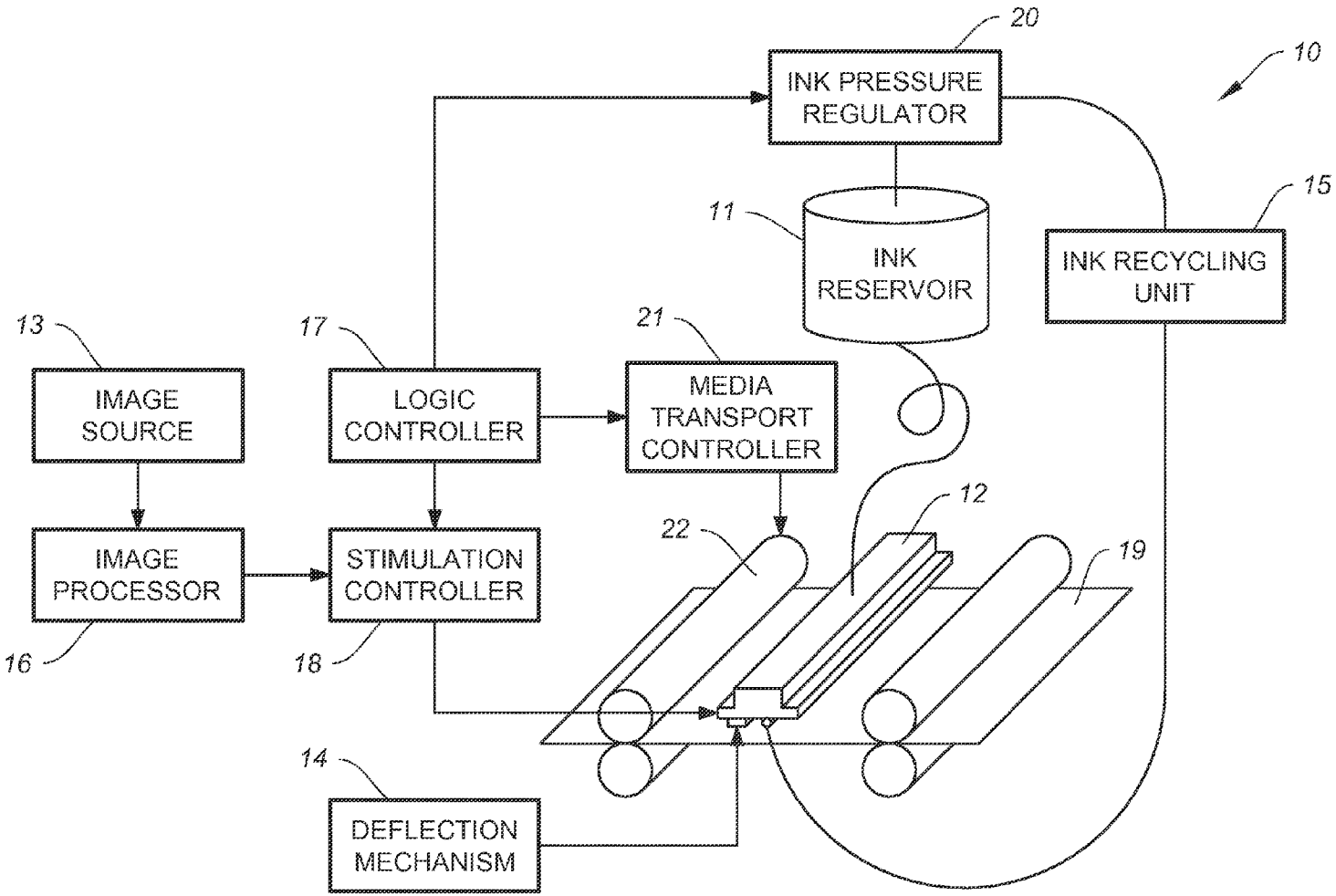
FIG. 1 is a simplified block schematic diagram of an exemplary continuous inkjet system according to the present invention.

The present description will be directed in particular to elements forming part of, or cooperating more directly with, apparatus in accordance with the present invention. It is to be understood that elements not specifically shown or described may take various forms well known to those skilled in the art. In the following description and drawings, identical reference numerals have been used, where possible, to designate identical elements.

The example embodiments of the present invention are illustrated schematically and not necessarily drawn to scale for the sake of clarity. One of the ordinary skills in the art will be able to readily determine the specific size and interconnections of the elements of the example embodiments of the present invention.

As described herein, example embodiments of the present invention provide a printhead or printhead components typically used in inkjet printing systems. In such systems, the liquid is an ink for printing on a recording media. However, other applications are emerging, which use inkjet print heads to emit liquids (other than inks) that need to be finely metered and be deposited with high spatial resolution. As such, as described herein, the terms "liquid" and "ink" refer to any material that can be ejected by the printhead or printhead components described below.

Continuous ink jet (CIJ) drop generators rely on the physics of an unconstrained fluid jet, first analyzed in two dimensions by F. R. S. (Lord) Rayleigh, "Instability of jets," Proc. London Math. Soc. 10 (4), published in 1878. Lord Rayleigh's analysis showed that liquid under pressure, P, will stream out of a hole, the nozzle, forming a liquid jet of diameter $d_j$, moving at a velocity $v_j$. The jet diameter $d_j$ is approximately equal to the effective nozzle diameter $d_n$, and the jet velocity is proportional to the square root of the reservoir pressure P. Rayleigh's analysis showed that the jet will naturally break up into drops of varying sizes based on surface waves that have wavelengths $\lambda$ longer than $\pi d_j$, i.e. $\lambda \geq \pi d_j$. Rayleigh's analysis also showed that particular surface wavelengths would become dominate if initiated at a large enough magnitude, thereby "stimulating" the jet to produce mono-sized drops. Continuous ink jet (CIJ) drop generators employ a periodic physical process, a so-called "perturbation" or "stimulation" that has the effect of establishing a particular, dominate surface wave on the jet. The stimulation results in the break off of the jet into mono-sized drops synchronized to the fundamental frequency of the perturbation. It has been shown that the maximum efficiency of jet break off occurs at an optimum frequency $F_{opt}$ which results in the shortest time to break off. At the optimum frequency $F_{opt}$ the perturbation wavelength $\lambda$ is approximately equal to $4.5d_j$. The frequency at which the perturbation wavelength $\lambda$ is equal to $\pi d_j$ is called the Rayleigh cutoff frequency $F_R$, since perturbations of the liquid jet at frequencies higher than the cutoff frequency won't grow to cause a drop to be formed.

The drop stream that results from applying Rayleigh stimulation will be referred to herein as creating a stream of drops of predetermined volume. While in prior art CIJ systems, the drops of interest for printing or patterned layer deposition were invariably of unitary volume, it will be explained that for the present inventions, the stimulation signal may be manipulated to produce drops of various predetermined volumes. Hence the phrase, "streams of drops of predetermined volumes" is inclusive of drop streams that are broken up into drops all having one size or streams broken up into drops of planned different volumes.

In a CIJ system, some drops, usually termed "satellites" much smaller in volume than the predetermined unit volume, may be formed as the stream necks down into a fine ligament of fluid. Such satellites may not be totally predictable or may not always merge with another drop in a predictable fashion, thereby slightly altering the volume of drops intended for printing or patterning. The presence of small, unpredictable satellite drops is, however, inconsequential to the present invention and is not considered to obviate the fact that the drop sizes have been predetermined by the synchronizing energy signals used in the present invention. Thus the phrase "predetermined volume" as used to describe the present invention should be understood to comprehend that some small variation in drop volume about a planned target value may occur due to unpredictable satellite drop formation.

The example embodiments discussed below with reference to FIGS. 1-11 are described using particular combinations of components, for example, particular combinations of drop charging structures, drop deflection structures, drop catching structures, drop forming devices, and drop velocity modulating devices. It should be understood that these components are interchangeable and that other combinations of these components are within the scope of the invention.

A continuous inkjet printing system 10 as illustrated in FIG. 1 comprises an ink reservoir 11 that continuously pumps ink into a printhead 12 also called a liquid ejector to create a continuous stream of ink drops. Printing system 10 receives digitized image process data from an image source 13 such as a scanner, computer or digital camera or other source of digital data which provides raster image data, outline image data in the form of a page description language, or other forms of digital image data. The image data from the image source 13 is sent periodically to an image processor 16. Image processor 16 processes the image data and includes a memory for storing image data. The image processor 16 is typically a raster image processor (RIP). Image data also called print data in image processor 16 that is stored in image memory in the image processor 16 is sent periodically to a stimulation controller 18 which generates patterns of time-varying electrical stimulation pulses to cause a stream of drops to form at the outlet of each of the nozzles on printhead 12, as will be described. These stimulation pulses are applied at an appropriate time and at an appropriate frequency to stimulation device(s) associated with each of the nozzles. The printhead 12 and deflection mechanism 14 work cooperatively in order to determine whether ink droplets are printed on a recording media 19 at the appropriate positions designated by the data in image memory or deflected and recycled via the ink recycling unit 15. The recording media 19 is also called a receiver and it is commonly composed of paper, polymer, or some other porous substrate. The ink in the ink recycling unit 15 is directed back into the ink reservoir 11. The ink is distributed under pressure to the back surface of the printhead 12 by an ink channel that includes a chamber or plenum formed in a substrate typically constructed of silicon. Alternatively, the chamber could be formed in a manifold piece to which the silicon substrate is attached. The ink preferably flows from the chamber through slots and/or holes etched through the silicon substrate of the printhead 12 to its front surface, where a plurality of nozzles and stimulation devices are situated. The ink pressure suitable for optimal operation will depend on a number of factors, including geometry and thermal properties of the nozzles and thermal and fluid dynamic properties of the ink. The constant ink pressure can be achieved by applying pressure to ink reservoir 11 under the control of ink pressure regulator 20. Typical deflection mechanisms 14 include aerodynamic deflection and electrostatic deflection.

One well-known problem with any type inkjet printer, whether drop-on-demand or continuous ink jet, relates to the accuracy of ink drop positioning. As is well-known in the art of inkjet printing, one or more drops are generally desired to be placed within pixel areas (pixels) on the receiver, the pixel areas corresponding, for example, to pixels of information comprising digital images. Generally, these pixel areas comprise either a real or a hypothetical array of squares or rectangles on the receiver, and printer drops are intended to be placed in desired locations within each pixel, for example in the center of each pixel area, for simple printing schemes, or, alternatively, in multiple precise locations within each pixel areas to achieve half-toning. If the placement of the drop is incorrect and/or their placement cannot be controlled to achieve the desired placement within each pixel area, image artifacts may occur, particularly if similar types of deviations from desired locations are repeated on adjacent pixel areas. The RIP or other type of processor 16 converts the image data to a pixel-mapped image page image for printing. During printing, recording media 19 is moved relative to printhead 12 by means of a plurality of transport rollers 22 which are electronically controlled by media transport controller 21. A logic controller 17, preferably micro-processor based and suitably programmed as is well known, provides control signals for cooperation of transport controller 21 with the ink pressure regulator 20 and stimulation controller 18. The stimulation controller 18 comprises a drop controller that provides drop forming pulses, the drive signals for ejecting individual ink drops from printhead 12 to recording media 19, according to the image data obtained from an image memory forming part of the image processor 16. Image data may include raw image data, additional image data generated from image processing algorithms to improve the quality of printed images, and data from drop placement corrections, which can be generated from many sources, for example, from measurements of the steering errors of each nozzle in the printhead 12 as is well-known to those skilled in the art of printhead characterization and image processing. The information in the image processor 16 thus can be said to represent a general source of data for drop ejection, such as desired locations of ink droplets to be printed and identification of those droplets to be collected for recycling.

It should be appreciated that different mechanical configurations for receiver transport control can be used. For example, in the case of a page-width printhead, it is convenient to move recording media 19 past a stationary printhead 12. On the other hand, in the case of a scanning-type printing system, it is more convenient to move a printhead along one axis (i.e., a main-scanning direction) and move the recording media 19 along an orthogonal axis (i.e., a sub-scanning direction), in relative raster motion.

Drop forming pulses are provided by the stimulation controller 18 which may be generally referred to as a drop controller and are typically voltage pulses sent to the printhead 12 through electrical connectors, as is well-known in the art of signal transmission. However, other types of pulses, such as optical pulses, may also be sent to printhead 12, to cause print and non-print drops to be formed at particular nozzles, as is well-known in the inkjet printing arts. Once formed, print drops travel through the air to a recording media and later impinge on a particular pixel area of the recording media and non-print drops are collected by a catcher as will be described.

Figure 2A:
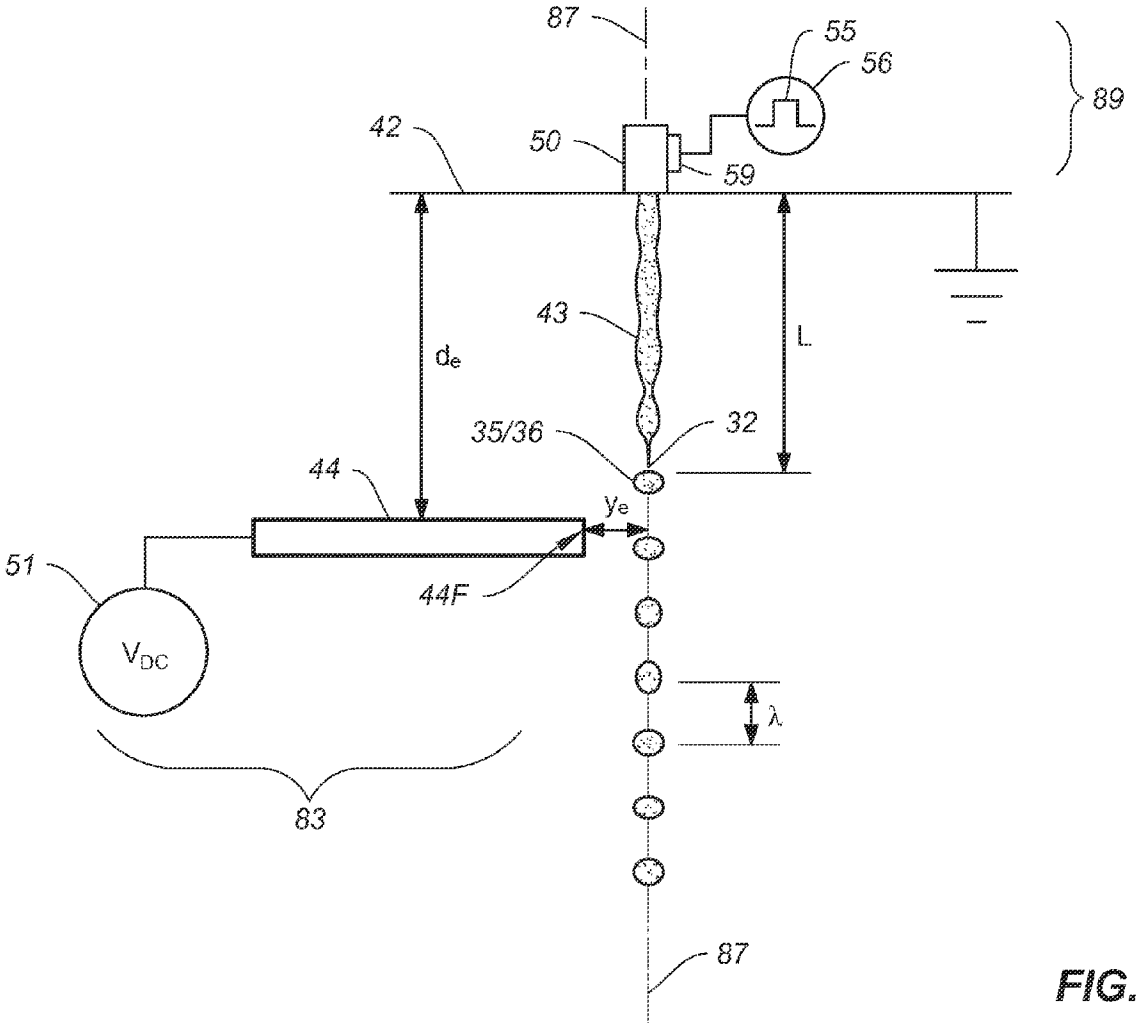
FIG. 2A shows an image of a liquid jet being ejected from a drop generator and its subsequent break off into drops at a location above the charge electrode.
Figure 2B:
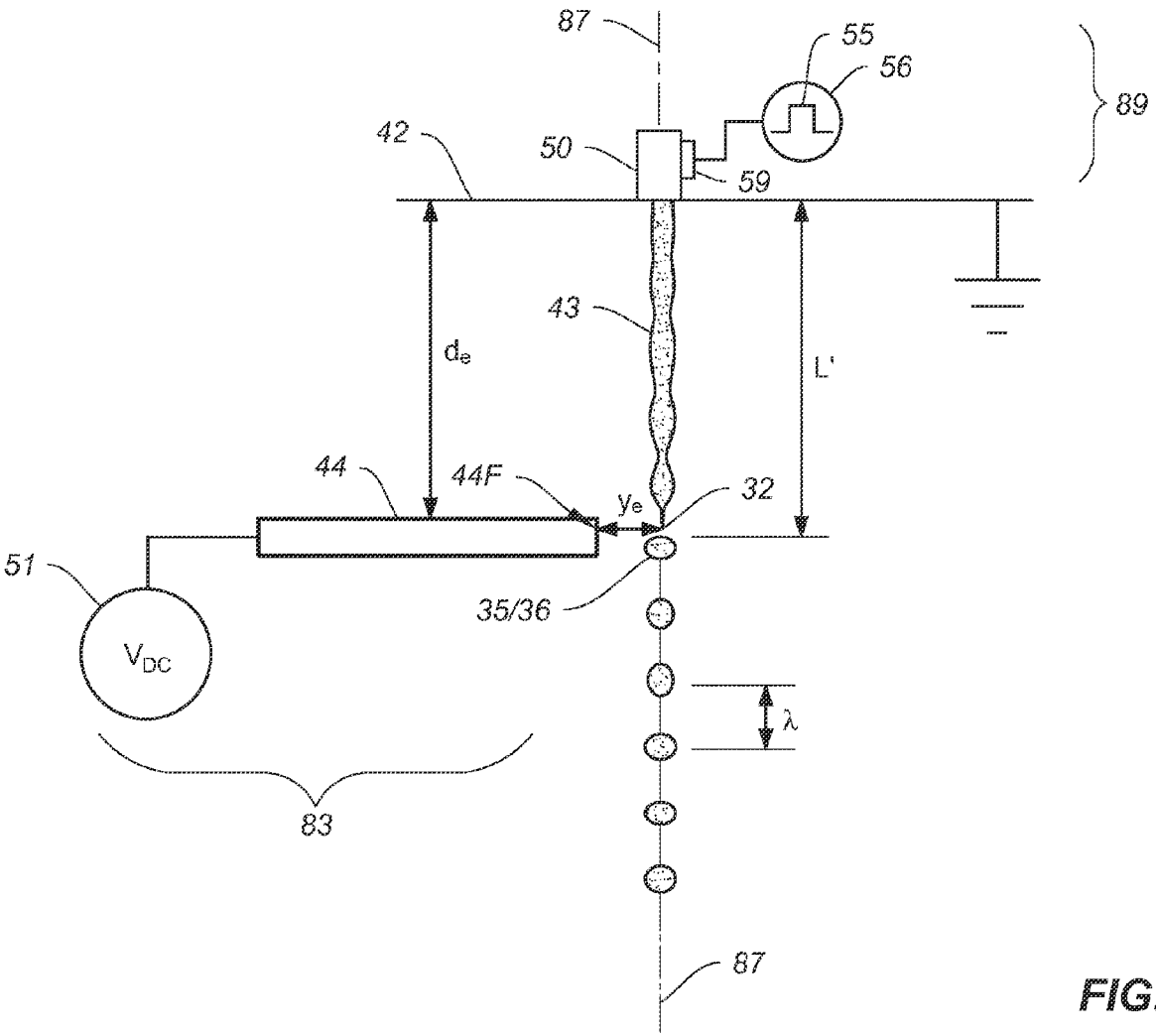
FIG. 2B shows an image of a liquid jet being ejected from a drop generator and its subsequent break off into drops at a location adjacent to the charge electrode.
Figure 2C:
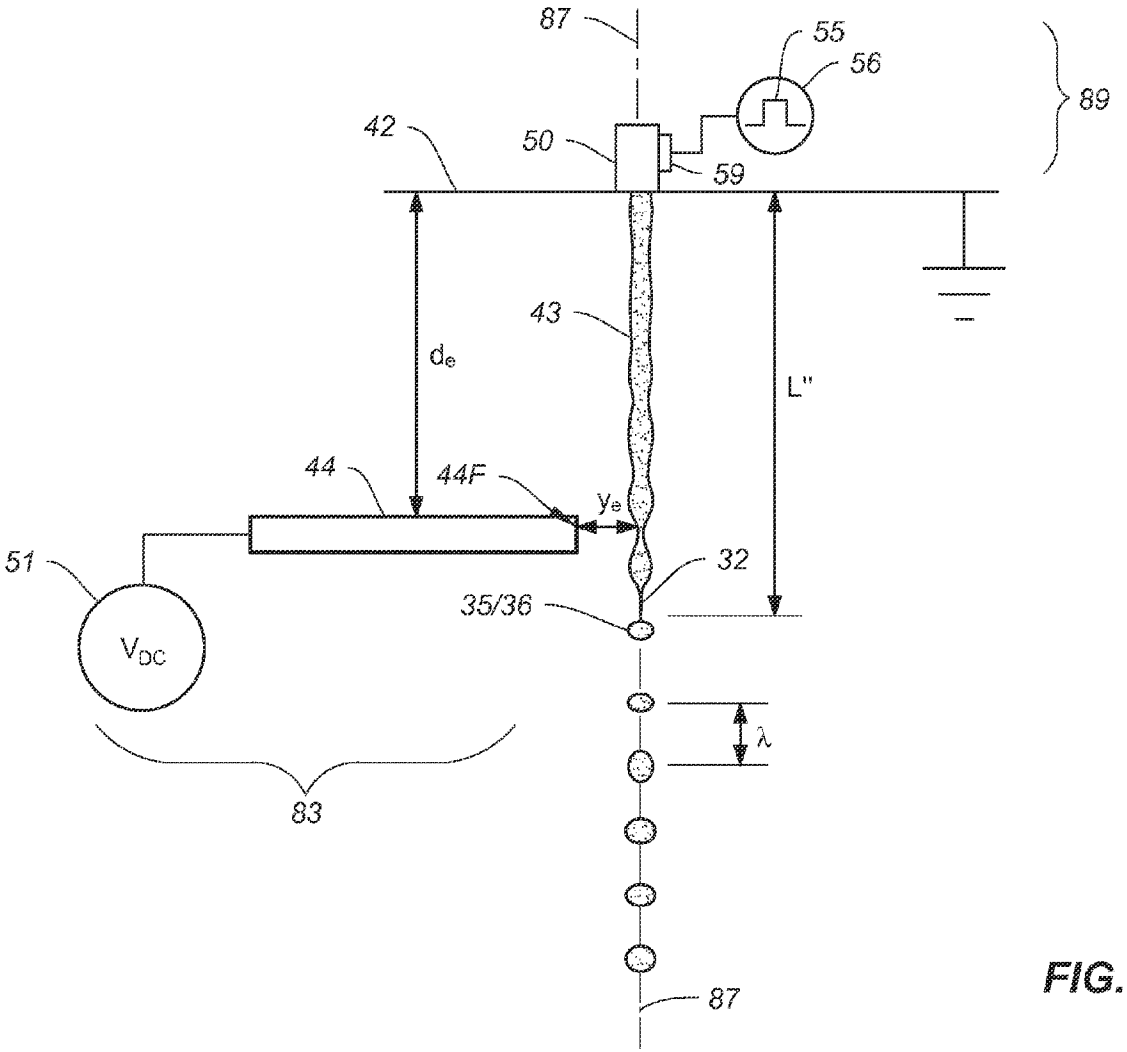
FIG. 2C shows an image of a liquid jet being ejected from a drop generator and its subsequent break off into drops at a location below the charge electrode.

The present invention relates to electrostatic deflection print drop deflection schemes that utilize one or more common charge electrodes each at a constant electric potential. These drop selection schemes include those based on breakoff length modulation, breakoff volume modulation and combinations of the two schemes. FIG. 2A-2C illustrates a print drop selection scheme that utilizes breakoff length modulation with constant drop volume. Referring to FIG. 2A-C the printing system has associated with it, a printhead having a nozzle orifice plane 42 that includes an array of nozzles 50. The printhead is operable to produce an array of liquid jets 43 emanating from the array of nozzles 50. FIG. 2A-2C show a liquid jet emanating from a nozzle 50 of the printhead 12 following a path along the liquid jet axis 87. Associated with each liquid jet 43 is a drop formation device 89. The drop formation device 89 includes a drop formation transducer 59 and a stimulation waveform source 56 that supply stimulation waveforms 55, also called drop formation waveforms, to the drop formation transducer 59. The drop formation transducers 59, commonly called stimulation transducers, can be of any type suitable for creating a perturbation on the liquid jet, such as a thermal device, a piezoelectric device, a MEMS actuator, an electrohydrodynamic device, a dielectrophoresis modulator, an optical device, an electrostrictive device, and combinations thereof. FIG. 2A-2C show generation of drops 35 or 36 labeled 35/36 of substantially the same volume produced at the fundamental drop formation frequency from a single nozzle 50 of an array of nozzles. As will be explained below drops 35 and 36 are referred to as print drops 35 and non-print drops 36 respectively. Usually the drop stimulation frequency of the drop stimulation transducers for the entire array of nozzles 50 in a printhead 12 is the same for all nozzles in the printhead 12. Under normal operation every drop can be printed and the maximum print frequency is equal to the fundamental drop formation frequency. The print period is defined as the minimum time interval between successive print drops coming from a single nozzle. A maximum of one print drop per nozzle can be printed during each print period and the print period is equal to the fundamental drop formation period $\tau_o$. In FIG. 2A-2C, liquid jets 43 break off into drops with a regular period at jet breakoff location 32, which is a distance L from the nozzle orifice plane 42 in FIG. 2A, distance L' from the nozzle orifice plane 42 in FIG. 2B, and distance L" from the nozzle orifice plane 42 in FIG. 2C respectively. In each of these cases the stimulation waveforms 55 which are applied to the drop formation transducers 59 are different. In all cases, the distance between a pair of successive drops produced at the fundamental frequency in FIG. 2A-2C is essentially equal to the wavelength $\lambda$ of the perturbation on the liquid jet.

In a binary printer, sequences of print or non print drops are generated in response to the input image data. During printing, communication signals from the stimulation controller 18 applied to the drop formation stimulation waveform source 56 are used to determine the order of formation of print and non-print drops, and the waveform source 56 provides different print drop and non-print drop stimulation waveforms 55 to the drop formation transducer 59 of drop formation device 89. The drop formation dynamics of drops forming from a liquid stream being jetted from an inkjet nozzle can be varied by altering the waveforms applied to the respective drop formation transducer 59 associated with a particular nozzle orifice 50. Changing at least one of the amplitude, duty cycle or timing relative to other pulses in the stimulation waveform 55 can alter the drop formation dynamics of a particular nozzle orifice. Changing the energy and/or duration of the pulses in the stimulation waveform 55 will alter the breakoff length 32 of the drops being formed at a fundamental period $\tau_o$. Usually a higher energy in the pulse waveform will result in a larger perturbation on the liquid jet 43 and result in a shorter breakoff length.

Also shown in FIGS. 2A-2C is a charging device 83 comprised of a charge electrode 44 and charging voltage source 51. The top of the charge electrode is located at a fixed distance $d_e$ from the nozzle orifice plane 42. The charging device 83 and charge electrode 44 is common to all of the jets formed by the nozzle array. Charge electrode 44 is also referred to as a first common charge electrode. The charging voltage source 51 supplies a constant electrical potential between the first common charge electrode 44 and the liquid jets 43. The front surface of the charge electrode $\mathbf{44}_F$ is located a distance $y_e$ from the jet axis 87. The liquid jet is usually grounded by means of contact with the liquid chamber of the grounded drop generator. When a non-zero voltage is applied to the charge electrode 44, an electric field is produced between the charge electrode and an electrically grounded liquid jet. The capacitive coupling between the charge electrode and the electrically grounded liquid jet induces a net charge on the end of the electrically conductive liquid jet. When the end portion of the liquid jet breaks off to form a drop any net charge on the end of the liquid jet becomes trapped on the newly formed drop. When the distance between the front surface of the charge electrode and the end of the liquid jet is changed the capacitive coupling between the charge electrode and the liquid jet will also change. Hence, the charge on the newly formed drops can be controlled by varying the distance between the charge electrode and the breakoff location 32 of the liquid jets 43. When the charge electrode 44 is positioned adjacent to the breakoff location 32 of the liquid jet 43 as shown at L' in FIG. 2B the charge induced on the drops will be a maximum.

When the breakoff location 32 of the liquid jet 43 is at a shorter distance L than the location $d_e$ of charge electrode 44 as shown in FIG. 2A the charge induced on the drops will be much less than the maximum. Similarly when the breakoff location 32 of the liquid jet 43 is at a longer distance L" than the location $d_e$ of charge electrode 44 as shown in FIG. 2C the charge induced on the drops will again be much less than the maximum. As discussed above different waveforms are needed to produce drops with different breakoff lengths. In a practical printer, two or more types of waveforms being called a print drop waveform and a non-print drop waveform are required. As described below with respect to the discussion of FIGS. 4A-4C it is possible to print lower charged drops and deflect and to catch or gutter highly charged drops. It is also possible to deflect and print highly charged drops and to gutter the less charged drops as described below in the discussion of FIGS. 5A-5C. The drops have been labeled as 35/36 in FIGS. 2A-2C as print drops 35 or non-print drops 36 since determination is dependent on the nature of deflection mechanisms and drop catching systems, which are described with reference to the discussion of FIGS. 4A-4C and FIGS. 5A-5C. In a practical binary printer, drops with only two distinct breakoff lengths are required. A printer can be built utilizing waveforms that generate breakoff lengths L and L' or breakoff lengths L' and L". In configurations where drops having the lower amplitude of charge are printed and drops of higher charge amplitude are not printed, drops that break off at either L or L" would become print drops 35 and drops that break off at L' would become non-print drops. In configurations where the more highly charged drops are printed, drops that break off at either L or L" would become non-print drops 36 and drops that break off at L' would become print drops.

In an actual printer, there are small variations in the breakoff lengths of print drops and of non-print drops being generated from different nozzles and from the same nozzle at different times. These small variations are due to normal dimensional tolerance variations between different nozzles, and slight fluctuations of the pressure and temperature in the liquid chamber as a function of position and time. The breakoff length of print drops is defined to be $L_p$ and the breakoff length of non-print drops to be $L_{np}$. For purposes of further discussion, the nominal breakoff length of print drops is defined to be $L_p$ and the nominal breakoff length of non-print drops to be $L_{np}$ where the nominal breakoff lengths $L_p$ and $L_{np}$ are defined as the average breakoff lengths off all print drops and all non-print drops respectively. As a result of these small breakoff length variations, print drops will break off with a breakoff length $L_p$ in the range $R_p=L_p\pm\Delta L_p$ where $\Delta L_p$ accounts for the variation in breakoff lengths of print drops and is typically smaller than a wavelength $\lambda$ of the liquid jets and in a well controlled printer can be smaller than one half $\lambda$ of the liquid jets. Similarly, all non-print drops will break off with a breakoff length $L_{np}$ in the range $R_{np}=L_{np}\pm\Delta L_{np}$ where $\Delta L_{np}$ accounts for the variation in the breakoff lengths of non print drops and is also typically smaller than a wavelength $\lambda$ of the liquid jet and in a well controlled printer can be smaller than one half $\lambda$ of the liquid jet. In order to properly practice this invention, the print drop breakoff length range $R_p$ and the non-print drop breakoff length range $R_{np}$ must be distinct from each other. The range $R_p$ includes the minimum print drop breakoff length to the maximum print drop breakoff length, and the range $R_{np}$ includes the minimum non print drop breakoff length to the maximum non print drop breakoff length. It is preferable that the breakoff length of any print drop and the breakoff length of any non-print drop differ by at least one wavelength $\lambda$ of the liquid jet and more preferably they should differ by at least $3\lambda$. In order to ensure that the breakoff length of any print drop break and the breakoff length of any non-print drop differ by at least one wavelength $\lambda$ of the liquid jet when $\Delta L_p=\lambda$ and $\Delta L_{np}=\lambda$ requires that the nominal breakoff lengths of print drops $L_p$ and non print drops $L_{np}$ should differ by at least $3\lambda$. In order to ensure that the breakoff length of any print drop break and the breakoff length of any non-print drop differ by at least one wavelength $\lambda$ of the liquid jet when $\Delta L_p=\frac{1}{2}\lambda$ and $\Delta L_{np}=\frac{1}{2}\lambda$ requires that the nominal breakoff lengths of print drops $L_p$ and non print drops $L_{np}$ should differ by at least $2\lambda$.

Figure 3:
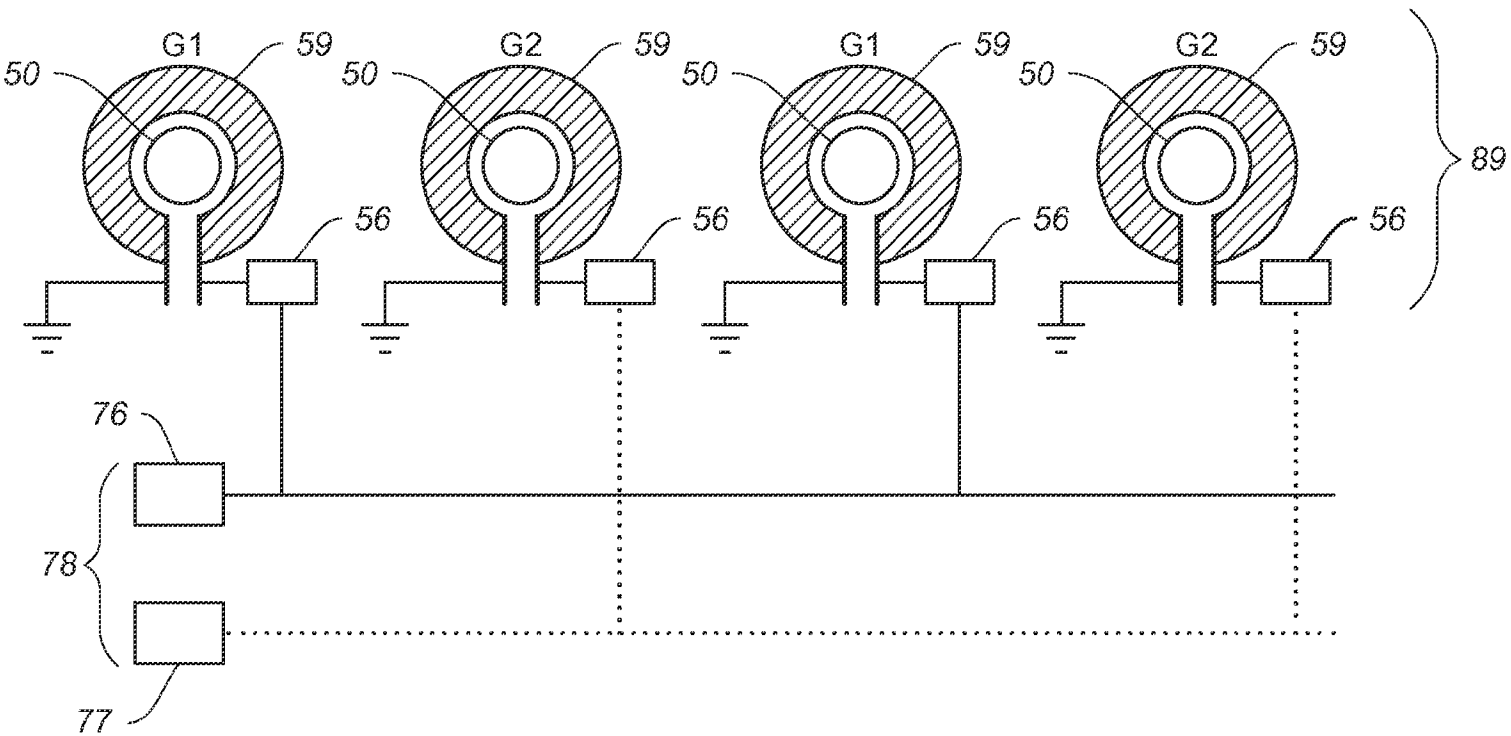
FIG. 3 is a simplified block schematic diagram of 4 adjacent nozzles arranged into 2 groups and associated jet stimulation devices according to one embodiment of the invention.

FIG. 3 shows 4 adjacent nozzles 50 of plurality of nozzles of a nozzle array arranged into 2 groups and associated jet stimulation devices according to one embodiment of the present invention. During operation, liquid is provided under pressure sufficient to eject liquid jets through the plurality of nozzles of the liquid chamber, the plurality of nozzles being disposed along a nozzle array direction. The plurality of nozzles are arranged into a first group G1 and a second group G2 in which the nozzles of the first group and second group are interleaved such that a nozzle of the first group is positioned between adjacent nozzles of the second group and a nozzle of the second group is positioned between adjacent nozzles of the first group. The end nozzles of the nozzle arrays are adjacent to a nozzle of the other group. Stimulation transducers 59 which are used to repetitively produce drops at the fundamental frequency $f_o$ are shown as thermal drop formation transducers are composed of a resistive load surrounding the nozzles 50. The stimulation transducers 59 are driven by a voltage supplied by the stimulation waveform source 56. The stimulation waveforms consist of a sequence of drop formation waveforms of print drop and non-print drop stimulation waveform segments as described above. Depending on the type of transducer used, the transducers can be located in or adjacent to the liquid chamber that supplies the liquid to the nozzles 50 to act on the liquid in the liquid chamber, be located in or immediately around the nozzles to act on the liquid as it passes through the nozzle, or located adjacent to the liquid jet to act on the liquid jet after it has passed through the nozzle. The drop formation waveform source supplies a waveform having a fundamental frequency $f_o$ with a corresponding fundamental period of $\tau_o=1/f_o$ to the drop formation transducer, which produces a modulation with a wavelength $\lambda$ in the liquid jet. Fundamental frequency $f_o$ is typically close to $F_{opt}$ and always less than $F_R$. The modulation grows in amplitude to cause portions of the liquid jet break off into drops. Through the action of the drop formation device, a sequence of drops can be produced at a fundamental frequency $f_o$ with a fundamental period of $\tau_o=1/f_o$.

In the practice of this invention, the distance between adjacent print drops in adjacent nozzles 50 of a printhead array is increased in order to minimize electrostatic interactions between neighboring print drops that cause drop placement errors upon printing on a receiver or recording media. In order to accomplish this, the plurality of nozzles are arranged into a first group and into a second group in which the nozzles of the first group and the second group are interleaved such that a nozzle of the first group is positioned between adjacent nozzles of the second group while a nozzle of the second group is positioned between adjacent nozzles of the first group. A first group trigger is applied to control the starting time of the stimulation waveforms to the first group of nozzles and apply a second group trigger delayed in time relative to the first group to control the starting time of the stimulation waveforms to the second group of nozzles. FIG. 3 shows a group timing delay device 78 comprising a first group trigger time delay 76 and a second group trigger time delay 77 which are simultaneously applied to each of the nozzles in their respective groups G1 and G2 to simultaneously trigger the start of the next drop forming pulse trains to each of the nozzles in their respective groups. In the practice this invention, it is required that each of the group trigger time delays 76 and 77 be distinct from each other. In the general case one of the time delays 76 or 77 may be zero, but not both of them. Thus the group timing delay device 78 shifts the timing of the drop formation waveforms supplied to the drop formation devices of nozzles of one of the first group or the second group so that the print drops formed from nozzles of the first group and the print drops formed from nozzles of the second group are not aligned relative to each other along the nozzle array direction. Print drops being formed in a line from a pair of adjacent nozzles will break off from the liquid jets at different times when there is a relative group time delay between the groups of nozzles. The relative group time delay is equal to the trigger time delay 77 minus the trigger time delay 76.

In other embodiments, instead of using a dedicated timing delay device 78, the timing delay is inherent to the stimulation waveforms 55 supplied to the drop formation devices 56 of nozzles 50 of one of the first group or the second group so that the print drops formed from nozzles of the first group and the print drops formed from nozzles of the second group are not aligned relative to each other along the nozzle array direction. In further embodiments, the timing delay can be achieved by shifting the input image data supplied to drop formation devices 56 associated with first and second nozzle groups to shift the timing of the drop formation waveforms 55 supplied to the drop formation devices of nozzles 50 of one of the first group or the second group so that the print drops formed from nozzles of the first group and the print drops formed from nozzles of the second group are not aligned relative to each other along the nozzle array direction.

In further embodiments, the nozzles are arranged into three or more nozzle groups, each group having its own distinct group timing delay and no two nozzles of the same group are adjacent to each other. When three nozzle groups are utilized the nozzles can be interleaved so that nozzles of the first group are adjacent to a nozzle of the second group and a nozzle of the third group, nozzles of the second group are adjacent to a nozzle of the third group and a nozzle of the first group and nozzles of the third group are adjacent to a nozzle of the second group and a nozzle of the first group. When three nozzle groups are utilized the nozzles can also be interleaved so that every other nozzle is member of one of the groups and the other two groups alternate being located between two nozzles in the group containing every other nozzle.

Figure 4A:
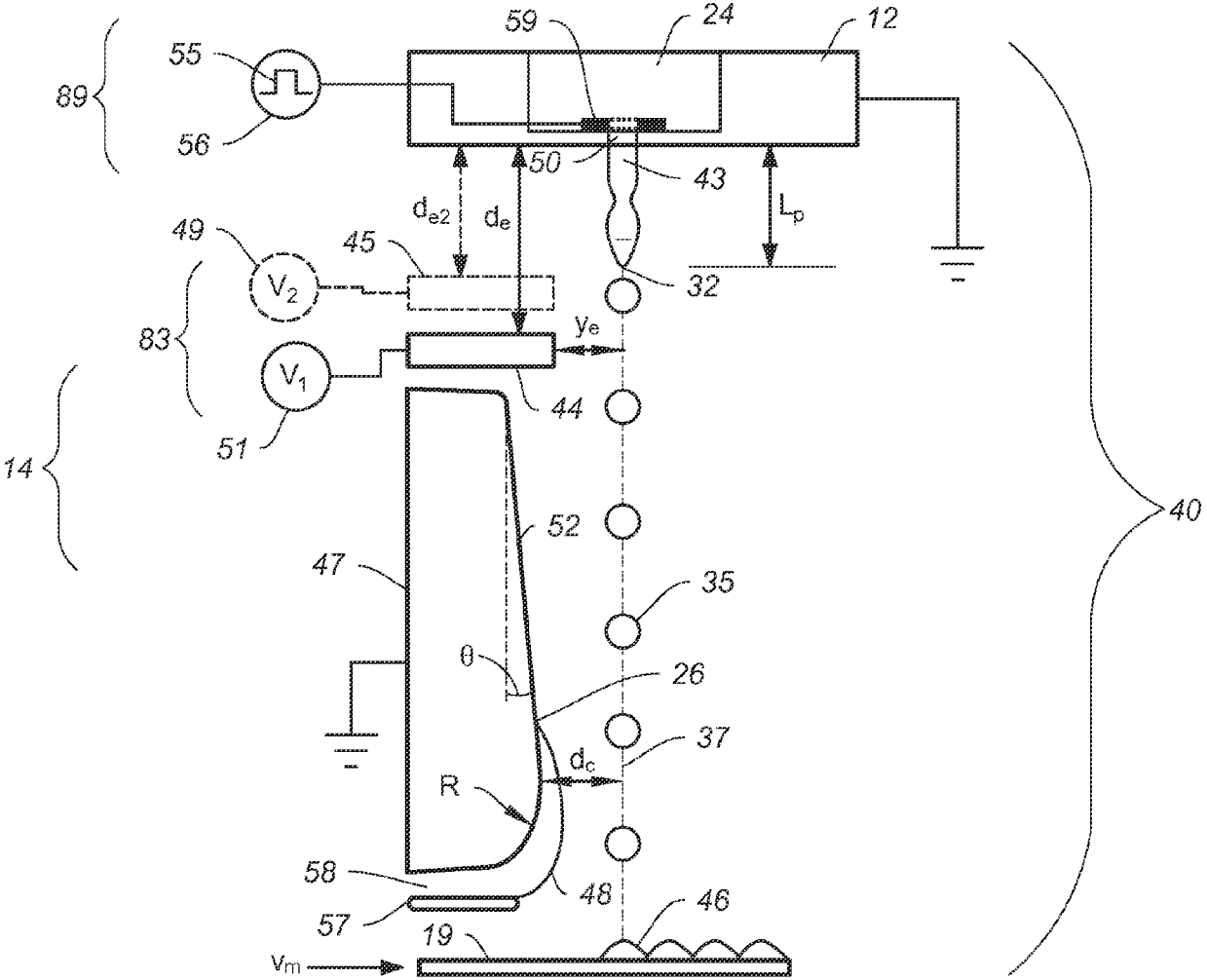
FIG. 4A shows a cross sectional viewpoint through a printhead of an embodiment of the invention operating in an all print condition.
Figure 4B:
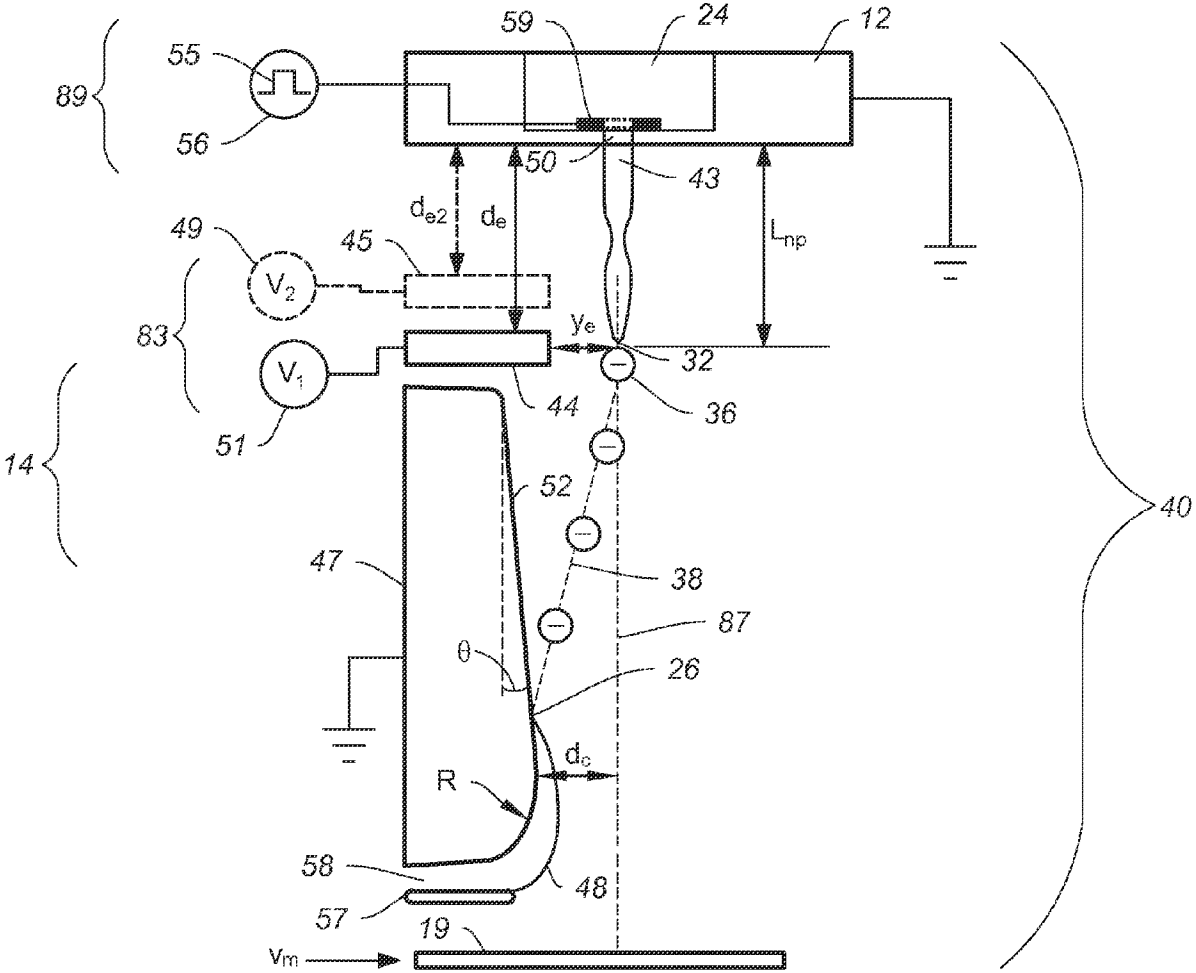
FIG. 4B shows a cross sectional viewpoint through a printhead of the embodiment of FIG. 4A operating in a no print condition.
Figure 4C:
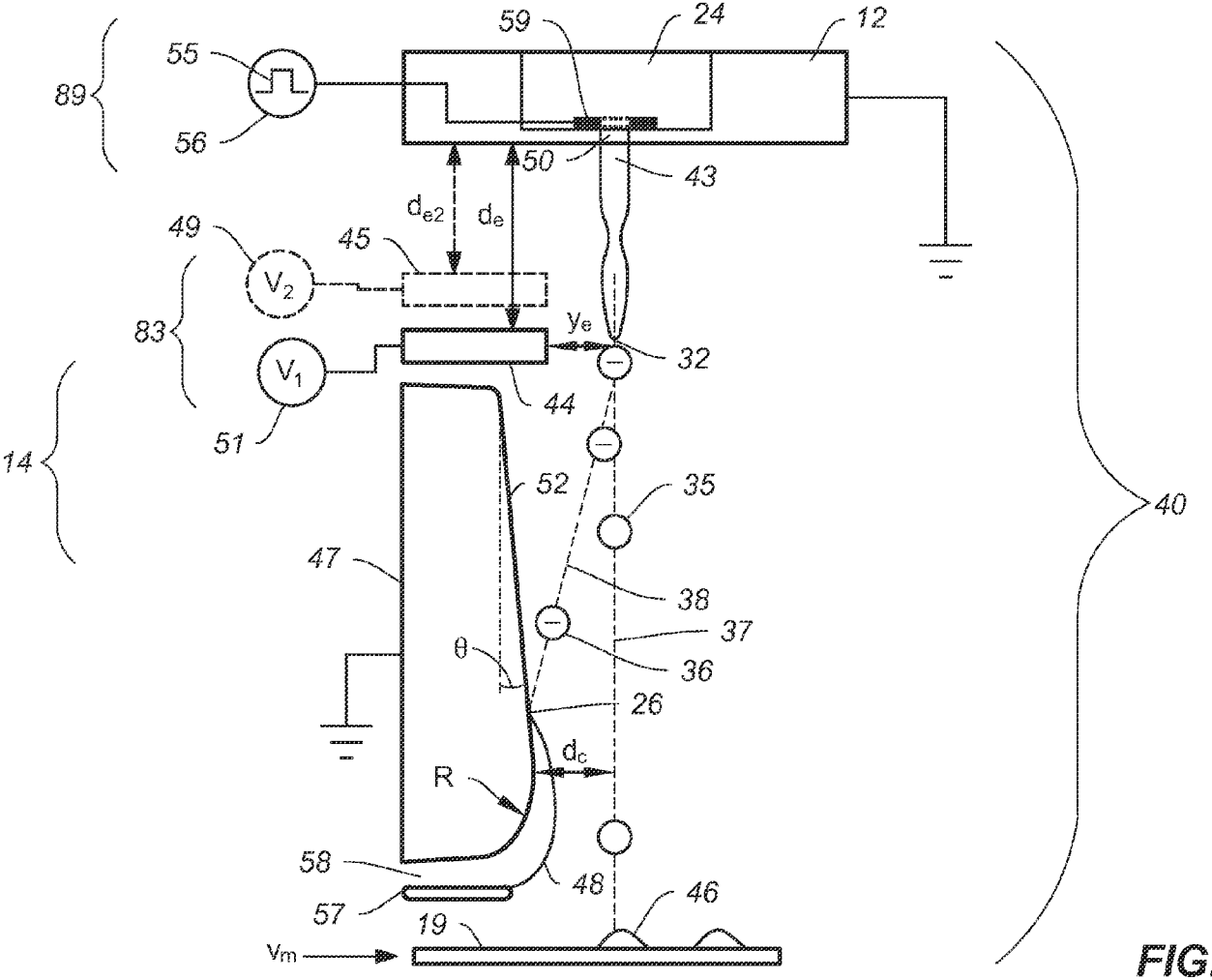
FIG. 4C shows a cross sectional viewpoint through a printhead of the embodiment of FIG. 4A operating in a general print condition.
Figure 5A:
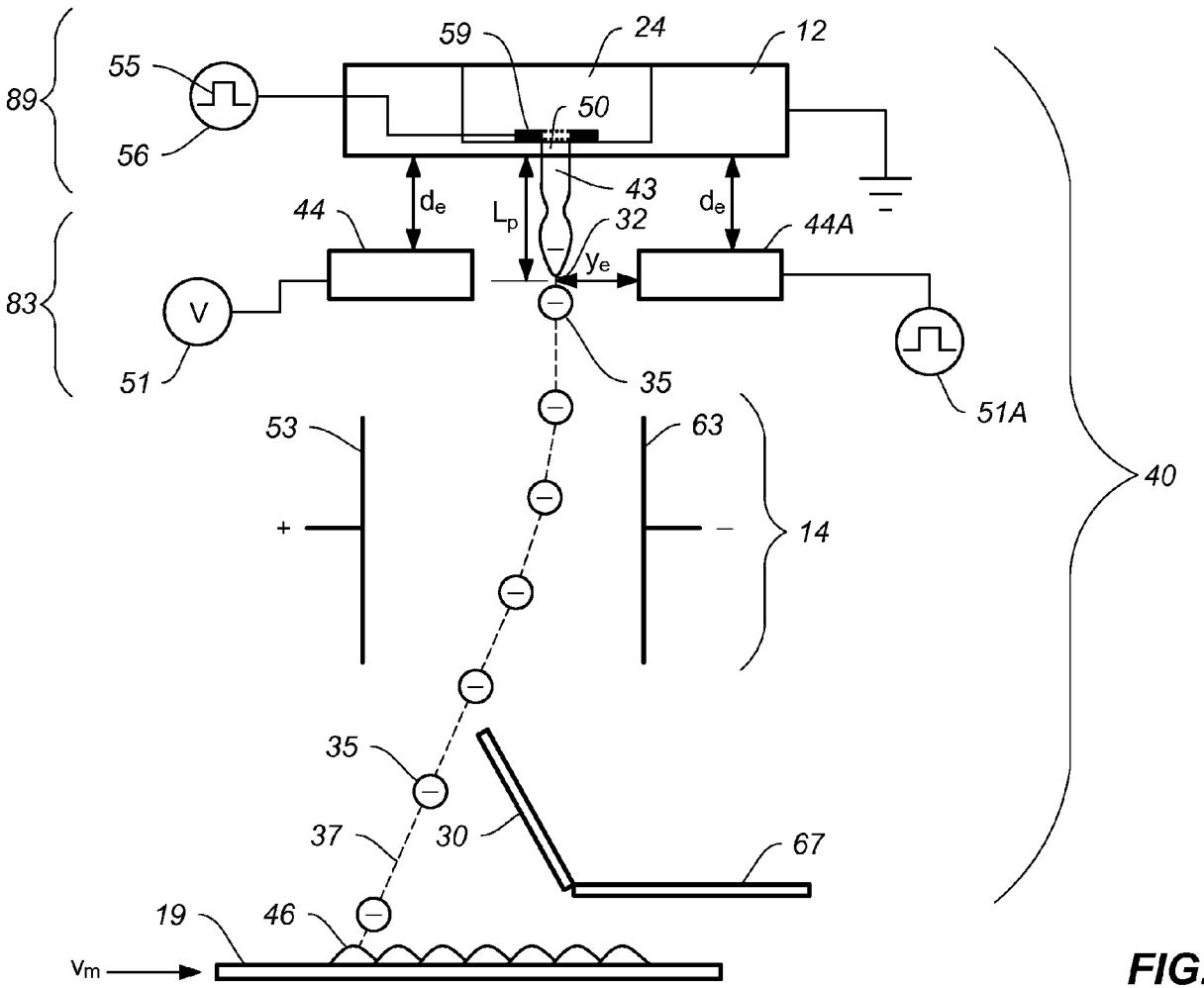
FIG. 5A shows a cross sectional viewpoint through a printhead of another embodiment of the invention operating in an all print condition.
Figure 5B:
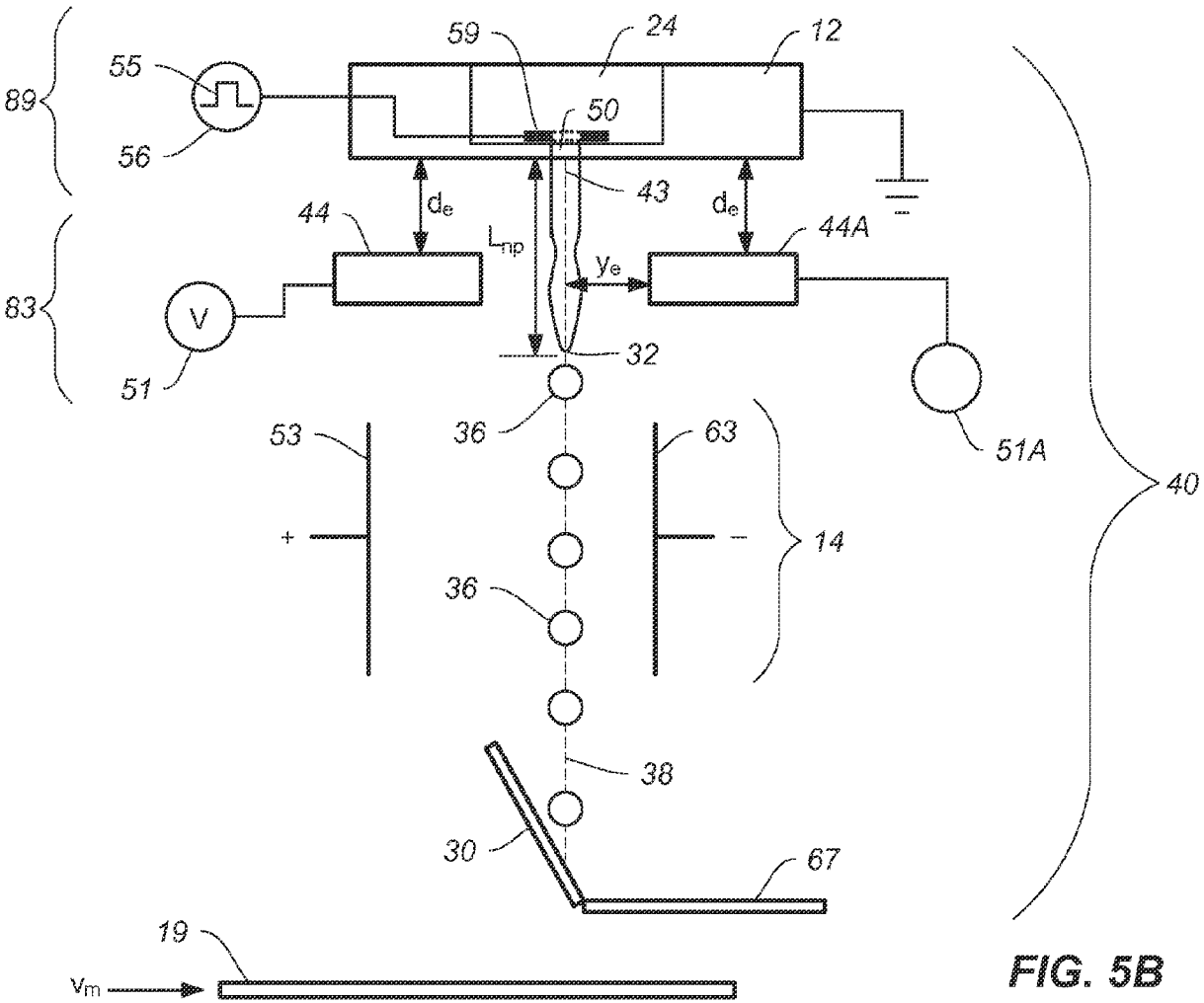
FIG. 5B shows a cross sectional viewpoint through a printhead of the embodiment of FIG. 5A operating in a no print condition.
Figure 5C:
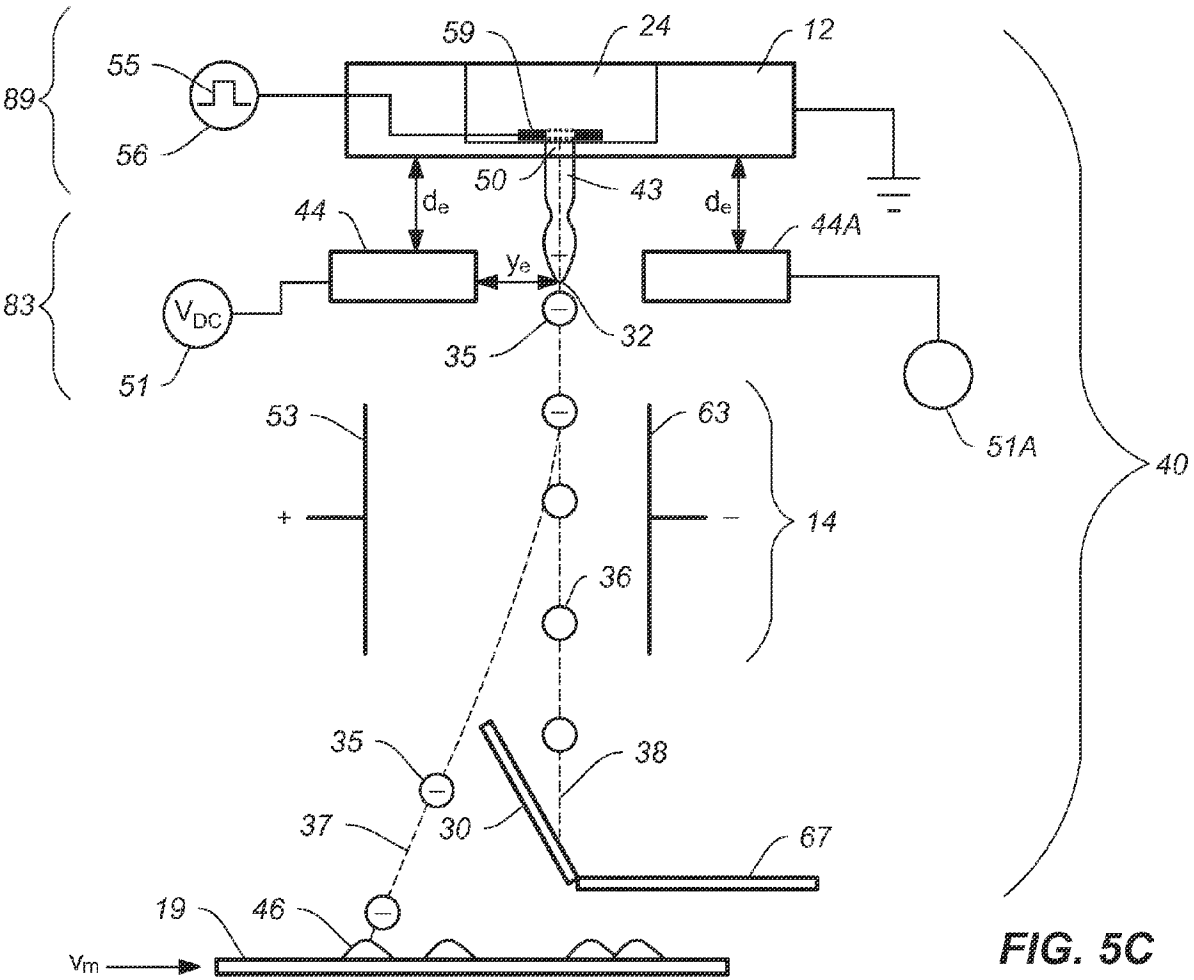
FIG. 5C shows a cross sectional viewpoint through a printhead of the embodiment of FIG. 5A operating in a general print condition.

FIGS. 4A-4C and FIGS. 5A-5C show various embodiments of a continuous liquid ejection system 40 used in the practice of this invention. FIGS. 4A-4C show a first embodiment of the invention having a first hardware configuration while operating to produce different print patterns on the recording media 19 in which print drops are relatively undeflected and allowed to be printed on the recording media and non-print drops are highly charged, deflected and captured. FIGS. 5A-5C show a second embodiment of the invention having a second common hardware configuration while operating to produce different print patterns on the recording media 19 in which non-print drops are relatively undeflected and captured while print drops are highly charged and deflected and are printed on the recording media. In FIGS. 4A-4C and FIG. 4A and FIG. 5A show different embodiments operating at the maximum recording media speed in all print conditions in which every drop generated is printed. FIG. 4B and FIG. 5B show the different embodiments operating in a no print condition in which none of the drops are printed. FIG. 4C and FIG. 5C show the different embodiments illustrating a general print condition in which some of the drops are printed and others are not printed.

The continuous liquid ejection system 40 embodiments illustrated in FIGS. 4A-4C and FIGS. 5A-5C include components described with reference to the continuous inkjet system shown in FIG. 1. These figures illustrate a liquid jet 43 being ejected from a nozzle 50 of an array of nozzles with an initial path coincident with the liquid jet axis 87. In these figures, the array of nozzles would extend into and out of the plane of the figure. Elements common to all of the embodiments shown in FIGS. 4A-4C and 5A-5C include printhead, also called a jetting module and a liquid ejector 12, drop formation device 89, and recording media 19 for receiving print drops 35. Various embodiments of charging devices 83 and deflection mechanisms 14 are also included in the continuous liquid ejection systems 40 shown in FIGS. 4A-4C and 5A-5C. The continuous liquid ejection system 40 includes a printhead 12 comprising a liquid chamber 24 in fluid communication with an array of nozzles 50 for emitting liquid jets 43. The liquid chamber 24 is pressurized to a pressure sufficient to eject liquid jets 43 through the plurality of nozzles 50 of the liquid chamber, the plurality of nozzles being disposed along the nozzle array direction. The plurality of nozzles are arranged into a first group and second group in which the nozzles of the first group and second group are interleaved such that a nozzle of the first group is positioned between adjacent nozzles of the second group and a nozzle of the second group is positioned between adjacent nozzles of the first group as described with respect to FIG. 3. In other embodiments of this invention, the plurality of nozzles can also be arranged in a third nozzle group with nozzles of the third group being interleaved with nozzles of the first group and nozzles of the second group, wherein providing the timing delay device includes providing a timing delay device that is configured to shift the timing of the drop formation waveforms of the third group relative to the first group and the second group. In other embodiments more interleaved groups can be added in a similar manner.

Associated with each liquid jet 43 is a drop formation device 89 which functions to create a perturbation on the liquid jet 43 flowing through nozzle 50. The drop formation device 89 includes a stimulation waveform source 56 which provides a sequence of stimulation waveforms 55 to stimulation transducer 59; the sequence of waveforms being dependent on the input image data. In the embodiments shown, the stimulation transducer 59 is formed in the wall around the nozzle 50. Separate stimulation transducers 59 can be integrated with each of the nozzles in a plurality of nozzles. The stimulation transducer 59 is actuated by a drop formation waveform source 56 which provides the periodic stimulations of the liquid jet 43 at the fundamental frequency $f_o$. The amplitude, duration, timing and number of energy pulses in stimulation waveform 55 determine how, where and when drops form, including the breakoff timing, breakoff location and size of the drops. The time interval between the break off of successive drops determines the size (volume) of the drops.

During operation of the continuous liquid ejection system 40, print or image data from the stimulation controller 18 (shown in FIG. 1) is sent to the simulation waveform source 56 which creates patterns of time varying voltage pulses to cause a stream of drops to be formed from the liquid jet flowing from the nozzle 50 in response to the supplied data. The specific drop stimulation waveforms 55 provided by the stimulation waveform source 56 to the stimulation transducer 59, determine the breakoff lengths of successive drops and the size (volume) of the drops. The drop stimulation waveforms are varied in response to the print or image data supplied by the image processor 16 to the stimulation controller 18. Thus the timing of the energy pulses applied to the stimulation transducers from the stimulation waveform depends on the print or image data. In the practice of this invention, at least two different stimulation waveforms 55 are required to be used, one for print drops 35 which cause them to have a breakoff length in the range $R_p=L_p\pm\Delta L_p$ and one for non-print drops 36 which cause them to have a breakoff length in the range $R_{np}=L_{np}\pm\Delta L_{np}$ in response to the input image data. The breakoff length ranges $R_p$ and $R_{np}$ are distinct from each other.

The various embodiments of the charging devices 83 are comprised of charge electrode 44, 44A and optional second charge electrode 45 and corresponding charging voltage sources 51, 51A and optional second charging voltage source 49 which provide constant voltages to the corresponding charge electrode. The deflection mechanisms 14 include components which are responsible for causing some drops to deflect. In the embodiments shown in FIGS. 4A-4C, the deflection mechanism is comprised of the charging devices 83 and the catcher 47 while in the embodiments shown in FIGS. 5A-5C the deflection mechanism is comprised of deflection electrodes 53 and 63.

When a voltage potential is applied to charge electrode 44 located to one side of the liquid jet adjacent to the breakoff point as shown in FIG. 4B, the charge electrode 44 attracts the charged end of the jet prior to the break off of a drop, and also attracts the charged drops 36 after they break off from the liquid jet. This deflection mechanism has been described in J. A. Katerberg, "Drop charging and deflection using a planar charge plate", 4th International Congress on Advances in Non-Impact Printing Technologies. The catcher 47 also makes up a portion of the deflection device 14. As described in U.S. Pat. No. 3,656,171 by J. Robertson, charged drops passing in front of a conductive catcher face cause the surface charges on the conductive catcher face 52 to be redistributed in such a way that the charged drops are attracted to the catcher face 52.

In order to selectively print drops onto a substrate, catchers are utilized to intercept non-print drops 36 which can then be sent to the ink recycling unit 15. FIGS. 4A-4C show a first embodiment in which a grounded catcher 47 positioned below the charge electrode 44 intercepts drops traveling along the non-print drop path 38 while allowing print drops 35 traveling down the print drop path 37 to contact the recording media 19 and be printed. In the embodiments shown in FIGS. 4A-4C the non-print drops are highly charged, deflected, captured by catcher 47 and recycled, while the print drops have a relatively low charge and are relatively undeflected and are printed on recording media 19. In FIG. 4A the breakoff length 32 of print drops 35 is $L_p$ which is less than the charge electrode 44 to nozzle plane distance $d_e$ so that a relatively low amount of charge is transferred to the print drops 35 as they break off. The print drops are not deflected by the grounded catcher 47 and they follow the relatively undeflected path 37 and are subsequently printed on recording media 19 as printed ink drops 46. In FIG. 4B the breakoff length 32 of non-print drops 36 is $L_{np}$ which is close to the charge electrode 44 to nozzle plane distance $d_e$ so that a large charge is transferred to the non-print drops 35 as they break off. The non-print drops are deflected by the grounded catcher 47 and they follow the path 38 and are subsequently captured as they bump into catcher face 52 at non-print drop catcher contact location 26. In FIG. 4C some drops are print drops 35 with breakoff length $L_p$ which follow the relatively undeflected path 37 and some drops are non-print drops 36 with breakoff length $L_{np}$ and follow the highly deflected path 38.

The catcher 47 shown in FIGS. 4A-4C also enables recycling of the ink that is not printed so that it can be jetted through the print head again. For proper operation of the printhead 12 shown in these figures, the catcher 47 and/or the catcher bottom plate 57 are grounded to allow the charge on the intercepted drops to be dissipated as the ink flows down the catcher face 52 and enters the ink recovery channel 58 where the ink is recirculated. The catcher face 52 of the catcher 47 makes an angle θ with respect to the liquid jet axis 87 which is shown in FIG. 2. Charged drops 36 are attracted to catcher face 52 of grounded catcher 47. Non-print drops 36 intercept the catcher face 52 at charged drop catcher contact location 26 to form an ink film 48 traveling down the face of the catcher 47. The bottom of the catcher has a curved surface of radius R, includes a bottom catcher plate 57 and an ink recovery channel 58 above the bottom catcher plate 57 for capturing and recirculation of the ink in the ink film 48. During printing it is necessary that print drops do not approach and intercept the ink film which is formed by accumulation of non print drops on the catcher face 52. Vacuum suction is usually in the ink recovery channel 58 so that the ink film 48 does not grow in thickness. The closest point of contact from the catcher face 52 to the print drop path 37 is $d_e$, and the ink film thickness is required to be less than $d_e$ minus the drop diameter, and preferable less than one half $d_e$.

When drops break off adjacent to the charge electrode 44, indicated by breakoff length $L_{np}$ in FIG. 4B, they become highly charged. When voltage source 51 applies a positive DC potential to the charge electrode 44 and the liquid jets 43 are grounded, a negative charge will be induced on the drops 36 breaking off adjacent to the charge electrode which are indicated by the minus signs inside the respective drops 36. Although no charge is shown on the drops that break off at locations $L_p$ which are not adjacent to the charge electrode 44 in these figures, it has been found that they usually have a charge on them that is smaller in magnitude to the drops that break off adjacent to the charge electrode 44 at $L_{np}$. In an alternate embodiment, a negative DC potential is applied to the charge electrode 44 while the liquid jets 43 are grounded so that a positive charge will be induced on the drops breaking off adjacent to the charge electrode.

In FIGS. 4A-4C an optional second charge electrode 45 is also shown to be at a distance $d_{e2}$ from the nozzle plane which is adjacent to breakoff location L of print drops 35. Applying a DC potential with optional voltage source 49 to the optional second charge electrode 45 can be utilized to increase the difference in charge between print and non-print drops which can result in greater separation between the print drop path 37 and the non-print drop path 38. The electrical potential applied to the second charge electrode is distinct from the electrical potential applied to the first charge electrode 44. In some embodiments the electrical potential applied to the second charge electrode 45 is ground potential. In such embodiments, the second charge electrode can serve as a shield, shielding the end of the liquid jet at one of the breakoff locations from the electric fields produced by the first charging electrode. By increasing the charge difference between the print drops and the non-print drops through the use of a second charging electrode, increased separation is produced between the trajectories of the print and non print drops, which allows non-print drops to be readily intercepted by the catcher. While FIGS. 4A-4C show the second charge electrode 45 positioned above the first charge electrode 44 and on the same side of the jet array as the first charge electrode 44, other configurations may be employed. For example, the second charge electrode can be located above the first charge electrode, closer to the nozzle plate than the first charge electrode, but located on the opposite side of the jet array. In yet another embodiment, the first electrode and/or the second charge electrode may include a first portion on one side of the jet array and a second portion on the second side of the jet array, where the first portion and the second portions of either the first electrode or the second electrode are maintained at a common electrical potential.

Even when a second charging electrode is used to increase the magnitude of the charge difference between the print and non-print drops, the print drops can be charged. Due to the charge on the print drops, electrostatic interactions will occur between nearby adjacent print drops as they are traveling in air toward the recording media. These electrostatic interactions can cause errors in drop placement on the recording media during printing. Utilizing the present invention to increase the distance between adjacent print drops by arranging the nozzles into interleaved groups minimizes these drop placement errors by increasing the distances in air between adjacent print drops from adjacent nozzles.

FIGS. 5A-5C shows cross sectional viewpoints through a liquid jet of a second embodiment of this invention in which relatively non-deflected non-print drops 36 are collected by catcher 67 while deflected print drops 35 are allowed to pass by the catcher and be printed on recording media 19. In this embodiment print drops 35 are highly charged and deflected away from a catcher 67 as they travel along print drop path 37 allowing the print drops 35 to contact a recording media 19 and be printed. In this case the catcher 67 intercepts less charged non-print drops 36 traveling along the relatively undeflected non-print drop path 38. FIG. 5A shows a sequence of drops being generated in all print condition while printing at the maximum recording media speed, FIG. 5B shows a sequence of drops being generated in a no print condition and FIG. 5C shows a sequence of drops being generated in a normal print condition in which some of the drops are printed and some of the drops are not printed. As shown in FIG. 5A the breakoff length of print drops 35 is $L_p$ which is close to the charge electrodes 44 and 44A to nozzle plane distance $d_e$ so that a large charge is transferred to the print drops 35 as they break off. As shown in FIG. 5B the breakoff length of non-print drops 36 is $L_{np}$ which is larger than the charge electrodes 44 and 44A to nozzle plane distance $d_e$ so that little charge is transferred to the non-print drops 36 as they break off.

In the embodiment shown in FIGS. 5A-5C, the charge electrode includes a charge electrode 44 and a symmetric charge electrode 44A positioned on opposite sides of the liquid jet 43 with the liquid jet 43 centered between them with the liquid jet at distance $y_e$ from each side of the charge electrode. Charge electrode 44 and symmetric charge electrode 44A can be made of separate conductive materials or out of a single conductive material with a parallel gap being machined between the two halves to accommodate the array of liquid jets 43 between them. The left and right portions of the charge electrode are biased to the same potential by the charging voltage source 51 and 51A. The charging voltage source 51A can be the same source as charging voltage source 51 as they are usually held at the same potential. The addition of the symmetric charge electrode 44A on the opposite side of the liquid jet from the charging electrode 44 when biased to the same potential produces a region between the charging electrode portions 44 and 44A that is almost symmetric left to right about the center of the jet. As a result, the charging of drops breaking off from the liquid jet between the electrodes is very insensitive to small changes in the lateral position of the jet. The near symmetry of the electric field about the liquid jet allows drops to be charged without applying significant lateral deflection forces on the drops near break-off. In this embodiment, the deflection mechanism 14 includes a pair of deflection electrodes 53 and 63 located below the charging electrodes 44 and 44A. Typically the two deflection electrodes 53 and 63 are biased to opposite polarities relative to the grounded liquid jets. The electrical potential polarities shown in FIGS. 5A-5C on these two electrodes is shown to produce an electric field between the electrodes that deflects negatively charged drops to the left. The strength of the drop deflecting electric field depends on the spacing between these two electrodes and the voltage between them. In this embodiment, the deflection electrode 53 is positively biased, and the deflection electrode 63 is negatively biased. This allows negatively charged print drops 35 to be attracted toward the positive charged deflection electrode 53 and travel down print drop path 37.

In the embodiment shown in FIGS. 5A-5C, a knife edge catcher 67 has been used to intercept the non-print drops 36 which travel along the non-print drop path 38. Catcher 67, which includes a catcher ledge 30, is located below the pair of deflection electrodes 53 and 63. The catcher 67 and catcher ledge 30 are oriented such that the catcher intercepts less charged non-print drops 36 traveling along the non-print drop path 38, but does not intercept charged print drops 35 traveling along the print drop path 37. Preferably, the catcher is positioned so that the drops striking the catcher strike the sloped surface of the catcher ledge 30 to minimize splash on impact. The charged print drops 35 are printed on the recording media 19.

For a given drop formation fundamental period, the maximum recording media speed relative to the printhead, also called the maximum print speed is defined as the speed at which every successive drop that breaks off from the jet being excited at the fundamental frequency $f_a$ can be printed with the desired drop separation determined by the print resolution settings. As an example, for a print head printing at a resolution of 600 by 600 dpi (drops per inch) operating at a fundamental frequency of $f_o$=400 kHz the maximum print speed is 16.93 m/s or 3333.33 ft/min. An all print condition is defined as one in which every image pixel in the input image data is printed on the recording media 19. In general, the number of non-print drops formed in between successive print drops to print an all print condition is dependent on recording media speed. As examples when printing in an all print condition at half maximum recording media speed every other drop generated at the fundamental frequency $f_o$ will be printed and every other drop generated at the fundamental frequency $f_o$ will be a non-print drop. When printing in an all print condition at ¼ the maximum recording media speed, every fourth drop generated at the fundamental frequency $f_o$ will be printed and 3 successive drops generated at the fundamental frequency $f_o$ will be non-print drops. During printing, image data pixels which are to be result in print drops 35 which become printed ink drops 46 when they arrive at the recording media 19. In the all print condition, adjacent printed ink drops 46 are in contact with each other on the recording media 19.

FIGS. 6-9 show examples in which liquid under pressure sufficient to eject liquid jets through a plurality of nozzles of a liquid chamber is provided. Shown are sequences of lines of drops, being produced at a fundamental frequency $f_o$, traveling in air from adjacent nozzles labeled 1-7 or 1-4 before any of the drops are deflected and intercepted by a catcher. The distance between successive drops, generated from a single nozzle, is shown as λ in all the figures and is equal to the distance in air that a drop travels during one fundamental period $\tau_o$. In all these figures, the same print pattern is to be printed by all the nozzles in the array such that all of the adjacent nozzles are being requested to either form print drops or form non-print drops. This corresponds to printing a sequence of horizontal lines or solid regions depending on recording media speed. The print patterns in air shown on the left side of these figures, labeled A, do not utilize the methods of the present invention and are labeled prior art while the print patterns in air shown on the right side or the center of these figures, labeled B, C, and D, utilize the methods of this invention which divide the nozzles into groups of interleaved nozzles with relative group time delays between them. The print patterns in air labeled A shown in the left side of FIGS. 6-9 do not utilize any timing shift between stimulation of adjacent nozzles and the nozzles are not separated into two or more groups while the print patterns in air labeled B, C, and D shown in the right side of FIGS. 6-9 are generated from adjacent nozzles in two or more groups with timing shifts between triggering of stimulation of nozzles of different groups. In these figures, the drops are moving vertically from an array of nozzles that are arranged along the horizontal axis. In all these figures print drops 35 are indicated as patterned filled circles and, non-print drops 36 are indicated as solid black filled circles. In FIGS. 6-9, each column of drops corresponds to drops from an individual nozzle; the columns are labeled 1-7 or 1-4.

Figure 6B:
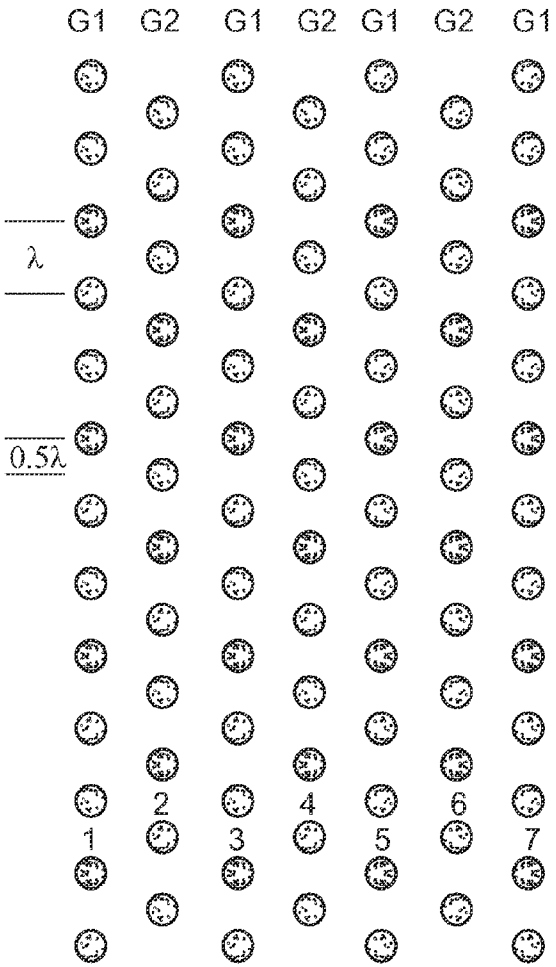
FIG. 6B (Prior Art)
FIG. 6B shows a sequence of drops traveling in air from 7 adjacent nozzles before being deflected in which every drop generated at the fundamental period is to be printed using a $0.5\tau_o$ timing shift between nozzles arranged in two nozzle groups according to an embodiment of this invention.
Figure 6A:
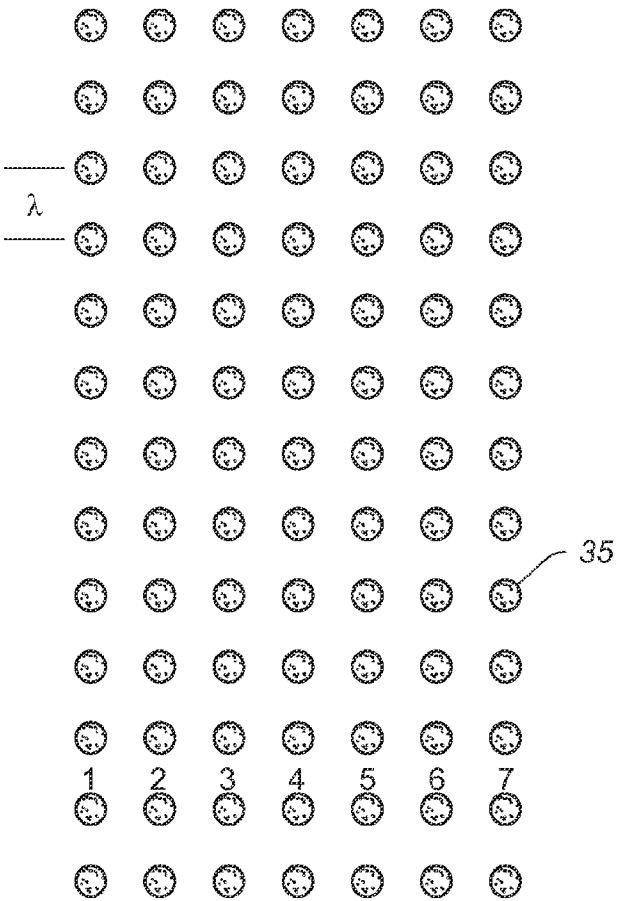
FIG. 6A (Prior Art)
FIG. 6A shows a sequence of drops traveling in air from 7 adjacent nozzles before being deflected in which every drop generated at the fundamental period is to be printed using no timing shift between nozzles in two different groups.
Figure 7C:
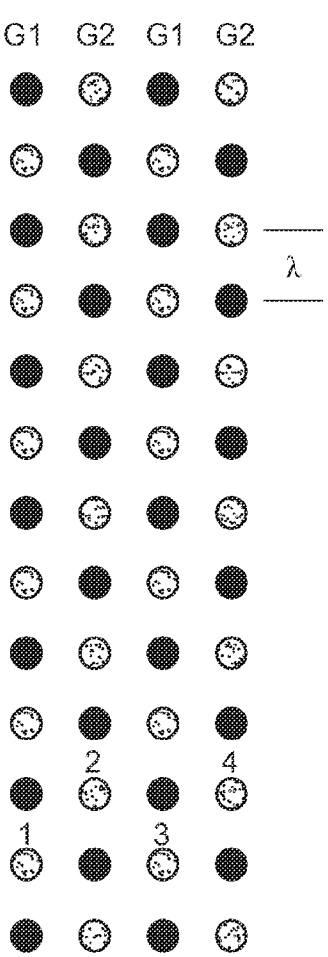
FIG. 7C (Prior Art)
FIG. 7C shows a sequence of drops traveling in air from 4 adjacent nozzles before being deflected in which every other drop generated at the fundamental period is to be printed using a $1.0\tau_o$ timing shift between nozzles arranged into two nozzle groups according to an embodiment of this invention.
Figure 7B:
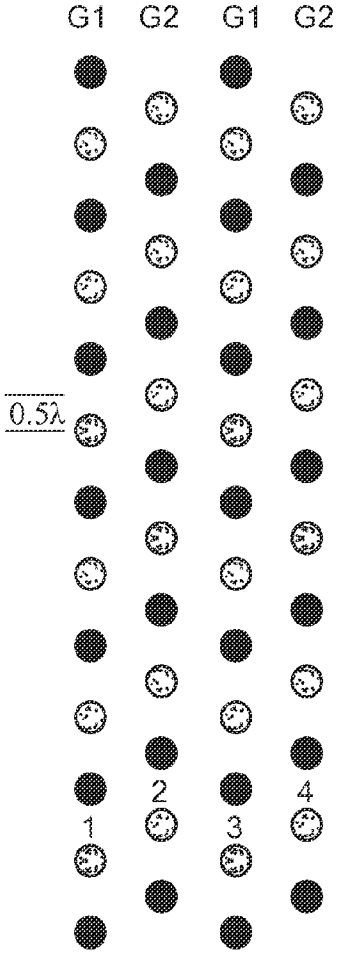
FIG. 7B (Prior Art)
FIG. 7B shows a sequence of drops traveling in air from 4 adjacent nozzles before being deflected in which every other drop generated at the fundamental period is to be printed using a $0.5\tau_o$ timing shift between nozzles arranged into two nozzle groups according to an embodiment of this invention.

In the examples shown in FIG. 6B, FIG. 7B and FIG. 7C the plurality of nozzles are disposed along a nozzle array direction with the plurality of nozzles being arranged into a first group G1 and second group G2 in which the nozzles of the first group and second group are interleaved such that a nozzle of the first group is positioned between adjacent nozzles of the second group and a nozzle of the second group is positioned between adjacent nozzles of the first group. A timing delay device is also provided to shift the timing of the drop formation waveforms supplied to the drop formation devices of nozzles of one of the first group or the second group so that the print drops formed from nozzles of the first group and the print drops formed from nozzles of the second group are not aligned relative to each other along the nozzle array direction. FIG. 8B, FIG. 8C, FIG. 6D and FIG. 9B show embodiments which include all of the above features of FIG. 6B, FIG. 7B and FIG. 7C, and additionally include a plurality of nozzles arranged in a third nozzle group G3, nozzles of the third group being interleaved with nozzles of the first group G1 and nozzles of the second group G2, wherein providing the timing delay device includes providing a timing delay device that is configured to shift the timing of the drop formation waveforms of the third group relative to the first group and the second group so that the print drops formed from nozzles of the first group, the print drops formed from nozzles of the second group and the print drops formed from nozzles of the third group are not aligned relative to each other along the nozzle array direction. FIGS. 6A and 6B are examples of all drop print modes operating at maximum print speed, and in both cases all drops have the same volume and are generated at a frequency $f_o$ corresponding to a time interval of $\tau_o$ between successive drop formations. At this print speed, the time required for the recording media to move relative to the printhead by one pixel spacing, this time being referred to as the pixel to pixel period or the print period, is equal to the fundamental drop formation period $\tau_o$. FIG. 6A shows a sequence of drops traveling in air from 7 adjacent nozzles in which every line of drops, generated at the fundamental period $\tau_o$, is to be printed using no timing shift between nozzles in different groups, this constitutes the prior art. FIG. 6B shows the same sequence of drops traveling in air from the same nozzles in which every drop created at the fundamental period is to be printed, according to an embodiment of this invention, using a $0.5\tau_o$ timing shift between the nozzles of the first group G1 and the nozzles of the second group G2. In the print mode shown in FIG. 6A, print drops in air labeled 1 and 2, 2 and 3, 3 and 4, 4 and 5, 5 and 6 and 6 and 7 are adjacent to each other with the distance between them being equal to the nozzle spacing. In the print mode practiced in this invention shown in FIG. 6B, the timing shift between the two groups causes adjacent print drops labeled 1 and 2, 2 and 3, 3 and 4, 4 and 5, 5 and 6 and 6 and 7 to be spaced are farther apart from each other as they travel through the air than in the case of FIG. 6A. As the electrostatic interactions between charge drops varies inversely with the spacing between the drops, the timing shift decreases the drop to drop electrostatic interactions on adjacent charged print drops resulting in less electrostatic repulsion between adjacent print drops.

Figure 10B:
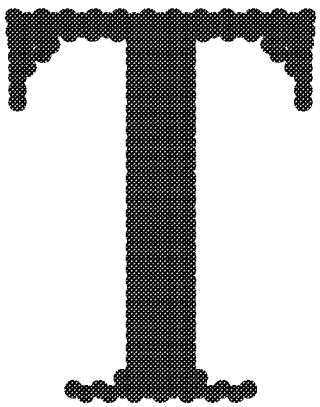
FIG. 10B illustrates a character printed with the reduced drop to drop interaction provided by the invention.
Figure 10A:
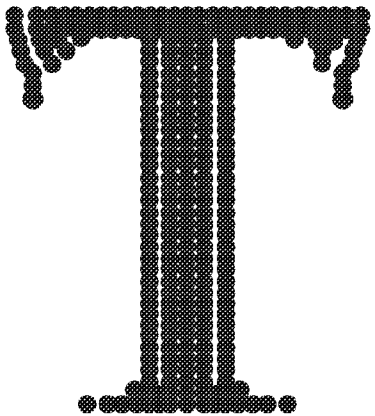
FIG. 10A illustrates the effect of drop to drop interaction on a character using a conventional printing system.

In the prior art systems, the electrostatic interactions between adjacent charged print drops causes the print drops to repel each other and move farther apart from each other. This can result in a spreading of the image when print drops are formed by 2 or more adjacent nozzles with non-print drops formed on either side of the adjacent print drops is illustrated in FIG. 10A. In FIG. 6B, when using a group timing delay of $0.5\tau_o$ between adjacent nozzles, there is significantly reduced electrostatic repulsion between adjacent print drops which results in reduced displacement of adjacent charged print drops from adjacent nozzles. As a result of the reduced drop to drop repulsion, there is much less spreading of print drops when they strike the recording media, as illustrated in FIG. 10B. FIGS. 6A and 6B are examples of printing in an all print mode at maximum print speed. The example shown in FIG. 6B, corresponds to printing every drop being generated at the maximum print speed, with a group timing delay of $0.5\tau_o$ between adjacent nozzles which corresponds to a one half print period offset between adjacent print drops along the nozzle array direction. When printed on recording media 19 at maximum print speed this appears as a one half image pixel offset between adjacent printed pixels along the nozzle array direction. This results in a fixed offset of one half image pixel between locations of printed drops created by the first nozzle group and the second nozzle group when viewed along the direction of receiver travel. While this one half pixel offset can be seen along the top and bottom edges of FIG. 10B, typically this one half pixel offset or stagger cannot be readily seen under normal viewing conditions.

The print period has been defined as the minimum time interval between successive print drops produced from a single nozzle at the maximum print speed and is equal to the fundamental drop formation period $\tau_o$. When printing at less than the maximum print speed it is convenient to define an effective print period which is equal to the minimum time interval between successive print drops coming from a single nozzle at the given print speed. The effective print period is equal to the drop formation period $\tau_o$ times the ratio of the maximum print speed to the actual print speed times. Thus when printing at ½ the maximum print speed, the effective print period is $2\tau_o$ and when printing at ¼ the maximum print speed, the effective print period is $4\tau_o$. When utilizing a group timing delay between adjacent nozzles, the magnitude in image pixels of the printed image offset, along the direction of relative motion between the printhead and the recording media, between nozzles of different groups is given by the ratio of the group timing delay to the effective print period. Thus when printing at one quarter maximum speed using a $0.5\tau_o$ group timing delay between adjacent nozzles will result in a one eighth image pixel offset between adjacent columns in the printed image.

Figure 7A:
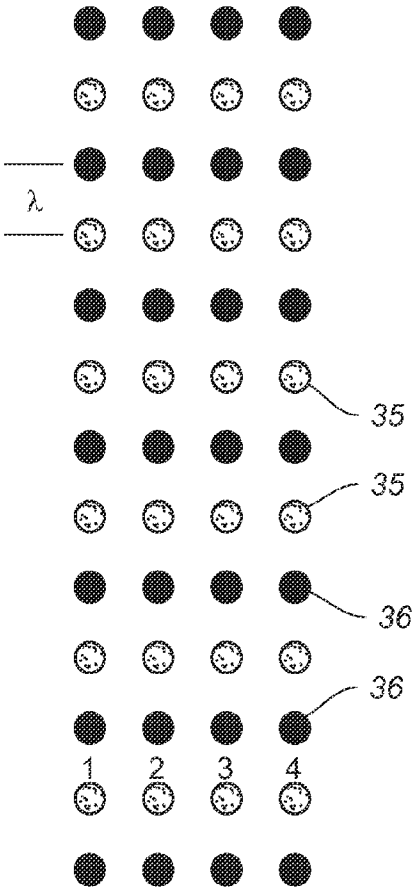
FIG. 7A (Prior Art)
FIG. 7A shows a sequence of drops traveling in air from 4 adjacent nozzles before being deflected in which every other drop generated at the fundamental period is to be printed using no timing shift between nozzles in different groups.

FIGS. 7A-7C each show examples of an all drop print mode operating at half maximum print speed. At this print speed, the effective print period, which is equal to the time required for the recording media to move relative to the printhead by a one pixel spacing is equal to $2.0\tau_o$, two times the fundamental drop formation period. FIG. 7A shows a sequence of drops traveling in air from 4 adjacent nozzles in which every other line of drops generated at the fundamental period is to be printed using no timing shift between nozzles in different groups; this is a prior art configuration. FIG. 7B shows the same sequence of drops traveling in air from the same nozzles in which every other line of drops generated at the fundamental period is to be printed using a $0.5\tau_o$ timing shift between the nozzles of a first nozzle group G1 and the nozzles of a second nozzle group G2 according to an embodiment of this invention. FIG. 7C shows the same sequence of drops traveling in air from the same nozzles in which every other line of drops generated at the fundamental period is to be printed using a $1.0\tau_o$ timing shift between the nozzles of the first nozzle group labeled G1 and the nozzles of the second nozzle group G2 according to an embodiment of this invention. In the prior art print mode shown in FIG. 7A, print drops in air labeled 1 and 2, 2 and 3 and 3 and 4 are adjacent to each other with the distance between them being equal to the nozzle spacing. In the print mode embodiment shown in FIG. 7B, print drops in air labeled 1 and 2, 2 and 3, 3 and 4 are again farther apart from each other than in the case of FIG. 7A as a result of the timing shift between the two nozzle groups. This decreases drop to drop electrostatic interactions on adjacent charged print drops resulting in less electrostatic repulsion between adjacent print drops. In the example shown in FIG. 7B, the electrostatic interactions between adjacent print drops from adjacent nozzles have been reduced by adding a one half the fundamental drop formation period $0.5\tau_o$ group timing delay shift in the formation of adjacent print drops along the nozzle array direction. This corresponds to a timing shift of one quarter of the print period. When printed on recording media 19 at this speed, the group timing delay shift between the nozzle groups produces a one quarter image pixel offset between adjacent printed image pixels along the nozzle array direction. In the example shown in FIG. 7C, the spacing between adjacent print drops have been further increased, and the electrostatic interactions between adjacent print drops from adjacent nozzles have been further reduced by using a one fundamental drop formation period $\tau_o$ group timing delay shift between the formation of the nozzles of the first group G1 and the nozzles of the second group G2. This timing shift corresponds to one half the print period. When printed on the recording media 19 at this speed, this group timing delay shift produces a one half image pixel offset between adjacent printed image pixels along the nozzle array direction. When printing at resolutions of 600 dpi or higher, such an offset is not visible under normal viewing conditions.

In FIG. 7B, the timing shift between the first and second groups is $0.5\tau_o$, the same time shift as is used in FIG. 6B, even though the print speed in FIG. 7B is one half the maximum print speed in FIG. 6B. These figures illustrate that in some embodiments of the invention, the group timing delay shift between nozzle groups is the same independent of print speed. In these embodiment, the image pixel offset in the printed image from nozzles of the two groups varies depending on the print speed; the offset between the groups is a one quarter pixel offset at the print speed of FIG. 7B and the print offset is one half pixel at the print speed of FIG. 6B. In this embodiment with a fixed timing shift between the nozzle groups, the spacing between nearest adjacent print drops, for example the spacing between a drop 1 and drop 2 pair remains constant independent of print speed. On the other hand, other embodiments of this invention use group timing delays between nozzle groups which depend on the print speed, so that the image pixel offset in the printed image from nozzles of different groups is the same and is independent of print speed. As an example FIG. 7C and FIG. 6B show a group timing delay shift between nozzle groups that varies depending on the print speed. The group time delay when printing at the maximum print speed in FIG. 6B is $0.5\tau_o$, which produces a one half image pixel offset in the printed image. In FIG. 7C, printing at half the maximum speed, the group time delay between nozzle groups is $1.0\tau_o$, twice the group time delay used in FIG. 6B, which also produces a one half image pixel offset in the print from nozzles in the two nozzle groups. In these other embodiments, the group timing delay varies with print speed so that the image pixel offset between nozzles in the two groups remains constant independent of print speed. Since the timing shift increases as the print speed is decreased, this embodiment provides increasing separation between print drops, and therefore decreasing drop to drop interactions as the print speed is decreased.

Figure 8B:
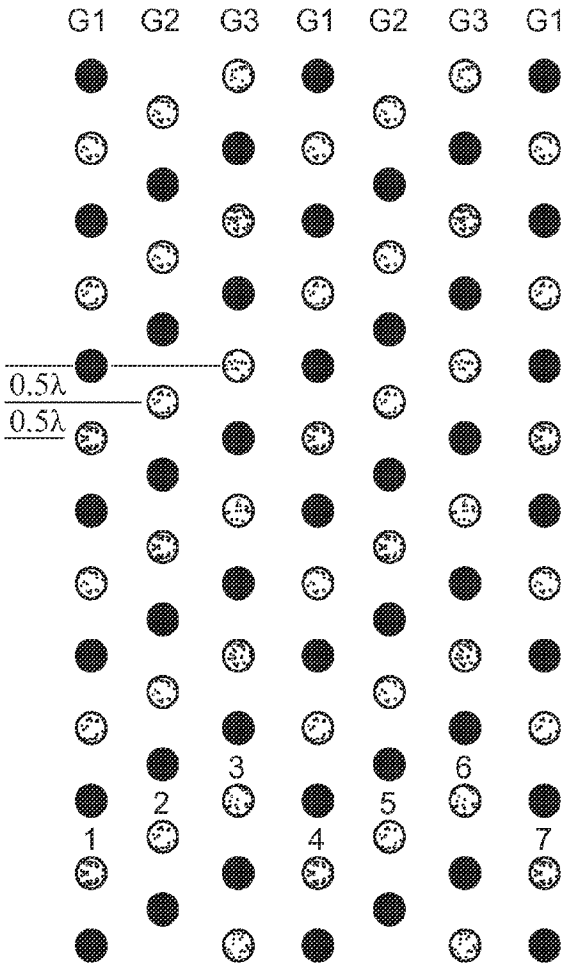
FIG. 8B (Prior Art)
FIG. 8B shows a sequence of drops traveling in air from 7 adjacent nozzles before being deflected in which every other drop generated at the fundamental period is to be printed using a $0.5\tau_o$ or $1.0\tau_o$ timing shift between adjacent nozzles arranged into three nozzle groups according to an embodiment of this invention.
Figure 8A:
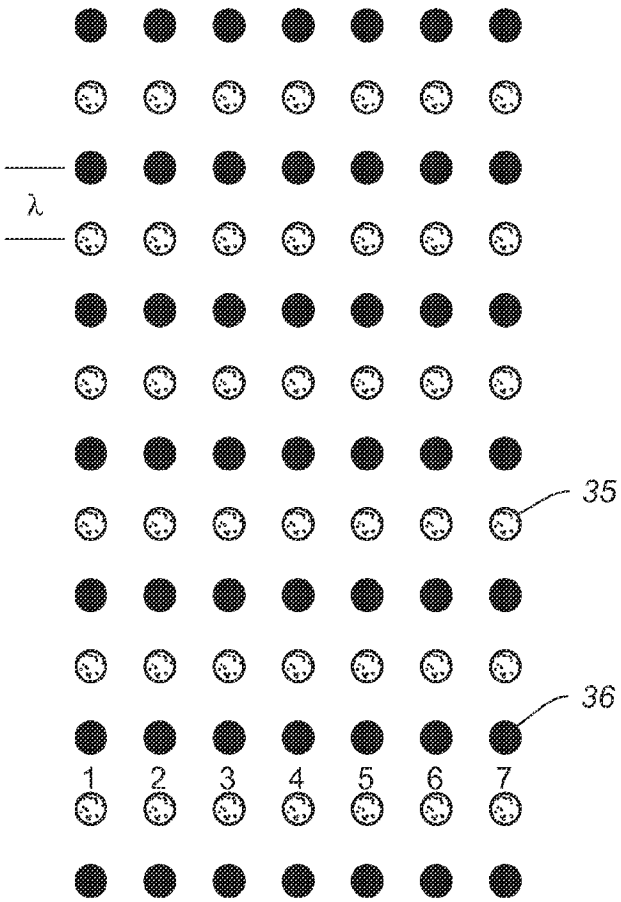
FIG. 8A (Prior Art)
FIG. 8A shows a sequence of drops traveling in air from 7 adjacent nozzles before being deflected in which every other drop generated at the fundamental period is to be printed using no timing shift between nozzles in different groups.
Figure 8D:
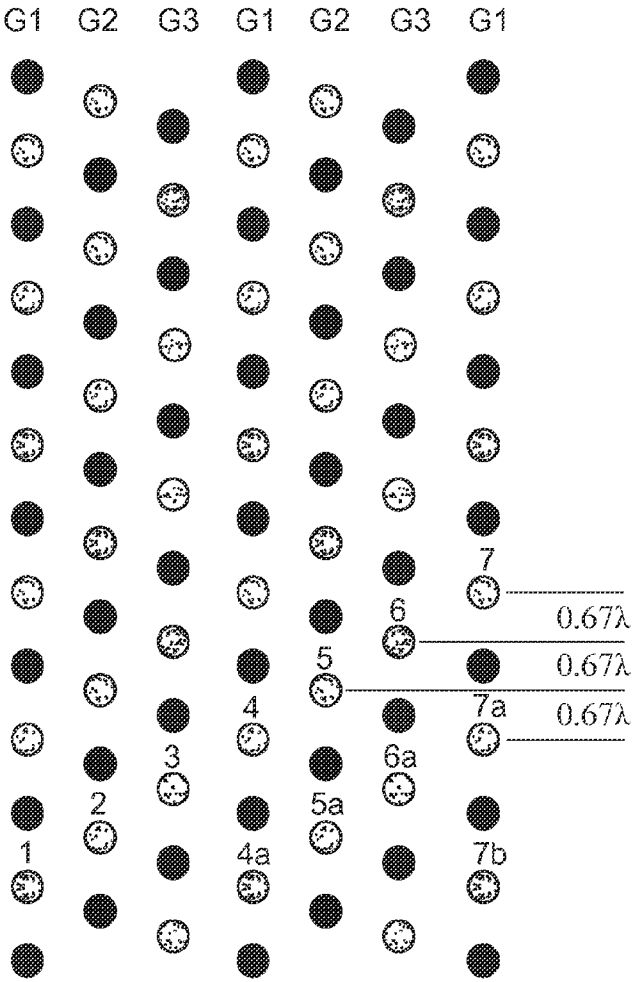
FIG. 8D shows a sequence of drops traveling in air from 7 adjacent nozzles in which every other drop generated at the fundamental period is to be printed using a $0.67\tau_o$ or $1.33\tau_o$ timing shift between adjacent nozzles arranged into three nozzle groups according to an embodiment of this invention.
Figure 8C:
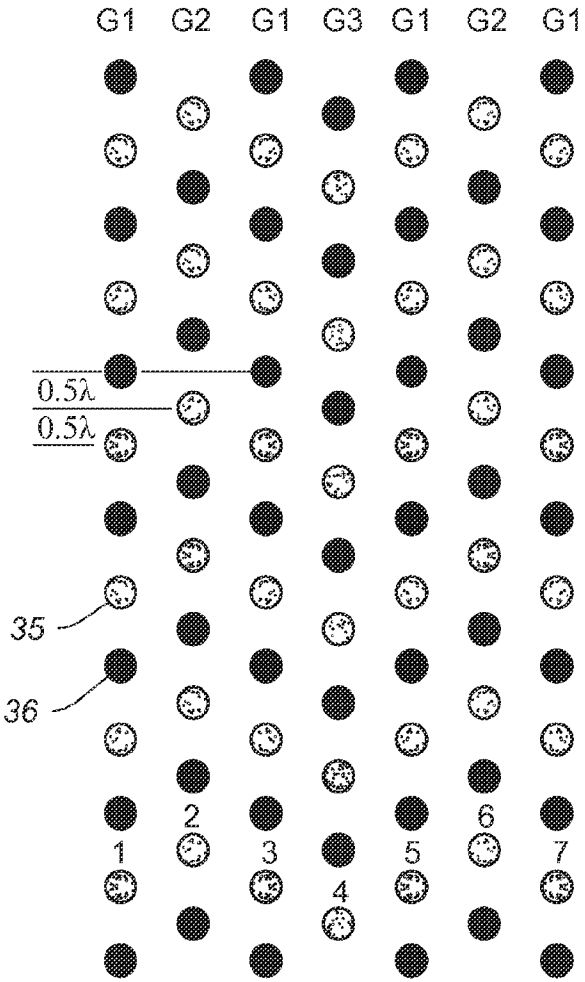
FIG. 8C shows a sequence of drops traveling in air from 7 adjacent nozzles in which every other drop generated at the fundamental period is to be printed using $0.5\tau_o$ timing shifts between adjacent nozzles arranged into three nozzle groups according to an embodiment of this invention.

FIGS. 8A-8D show examples of an all drop print mode operating at half maximum print speed. FIG. 8A shows a sequence of drops traveling in air from 7 adjacent nozzles in which every other line of drops generated by a nozzle at the fundamental period is to be printed with no timing delay shift between nozzles in different groups; this is a prior art timing. FIGS. 8B-8D show various embodiments of the invention in which the nozzles are arranged into three nozzle groups, with each nozzle group having its own distinct group timing delay and no two nozzles of the same group are adjacent to each other. FIGS. 8B and 8D show configurations in which the nozzles are interleaved so that nozzles of the first group are adjacent to a nozzle of the second group and a nozzle of the third group, nozzles of the second group are adjacent to a nozzle of the third group and a nozzle of the first group and nozzles of the third group are adjacent to a nozzle of the second group and a nozzle of the first group. FIG. 8C shows a configuration in which the nozzles are interleaved so that every other nozzle is a member of one of the groups and the other two groups alternate being located between two nozzles in the group containing every other nozzle.

FIG. 8B shows another embodiment of the invention forming the same sequence of drops traveling in air from the same nozzles shown in FIG. 8A in which the nozzles have been arranged in three interleaved nozzles groups in which the nozzles of the first group G1, the second group G2 and the third group G3 are interleaved such that a nozzle of the first group and a nozzle of the second group are positioned between adjacent nozzles of the third group and a nozzle of the second group and a nozzle of the third group are positioned between adjacent nozzles of the first group, and a nozzle of the first group and a nozzle of the third group are positioned between adjacent nozzles of the second group. In this embodiment, group timing delays of $0.5\tau_o$ and $1.0\tau_o$ are used between the nozzles of the three groups G1, G2 and G3; a group timing delay of $0.5\tau_o$ between group G1 and the adjacent group G2, a group timing delay of $0.5\tau_o$ between group G2 and the adjacent group G3, and a group timing delay of $1.0\tau_o$ between group G3 and the adjacent group G1 In the print mode shown in FIG. 8A print drops in air labeled 1 and 2, 2 and 3, 3 and 4, 4 and 5, 5 and 6 and 6 and 7 are adjacent to each other with the distance between them being equal to the nozzle spacing. In the print mode embodiment shown in FIG. 8B, print drops in air labeled 1 and 2, 2 and 3, 4 and 5, 5 and 6 have a $0.5\tau_o$ group timing delay shift between them and are again farther apart from each other than in the case of FIG. 8A and print drops in air labeled 3 and 4 and 6 and 7 have a $1.0\tau_o$ group timing delay shift between them causing them to be farther apart from each other than print drops in air labeled 1 and 2, 2 and 3, 4 and 5, 5 and 6 shown in FIG. 5A. This decreases charge to charge interactions on adjacent charged print drops resulting in less electrostatic repulsion between adjacent print drops. When printed on recording media 19 at half the maximum print speed this appears as one quarter image pixel and one half image pixel offsets between adjacent printed image pixels along the nozzle array direction.

In the embodiment shown in FIG. 8B the group delay timing shifts of $0.5\tau_o$ and $1.0\tau_o$ produce a symmetry break between groups 3 and groups 1. In certain printing applications, it is desirable to evenly split the phase shifts, to avoid the symmetry break. FIG. 8D shows the same nozzle group configuration as shown in FIG. 8B but using group timing delays of $\frac{2}{3}\tau_o$ between the nozzles of the three groups G1, G2 and G3; a group timing delay of $\frac{2}{3}\tau_o$ between group G1 and the adjacent group G2, a group timing delay of $\frac{2}{3}\tau_o$ between group G2 and the adjacent group G3, and a group timing delay of $\frac{2}{3}\tau_o$ between group G3 and the adjacent group G1. This embodiment evenly split the phase shifts between nozzles of adjacent groups and avoids the symmetry break of the embodiment in FIG. 8B. However, when printing a horizontal line that is more than three pixels wide, it becomes necessary introduce periodic pixels shifts into the data to avoid creating a slanted line. In the embodiment shown in FIG. 8D, the drops of each of the adjacent print drops in air labeled 1 and 2, 2 and 3, 3 and 4, 4 and 5, 5 and 6, 6 and 7 each have a $\frac{2}{3}\tau_o$ group timing delay shift between them. The line however slopes uphill to the right. To avoid this, it is necessary to shift the data for drops 4, 5, and 6 down by one pixel to drops 4*a*, 5*a*, and 6*a*, respectively, and the data for drop 7 down two pixels to drop 7*b*. Alternatively, the printhead can be skewed slightly relative recording medium and to the motion of the recording medium to compensate for the drift across the array. This embodiment also results in adjacent print drops being spaced farther apart from each other than in the case of FIG. 8A, decreasing the charge to charge interactions on adjacent charged print drops resulting in less electrostatic repulsion between adjacent print drops. When printed on recording media 19 at half the maximum print speed, this appears as one third image pixel and two thirds image pixel offsets between adjacent printed image pixels along the nozzle array direction.

FIG. 8C shows another embodiment of the invention forming the same sequence of drops traveling in air from the same nozzles in which the nozzles have been arranged in three interleaved nozzles groups in which adjacent nozzles of any of the nozzle groups are separated by at least one nozzle of at least one of the other groups. Adjacent nozzles of group G1 are separated by either one nozzle from group G2 or from group G3. Adjacent nozzles of group G2 are separated by two nozzles of group G1 and one from group G3. Similarly adjacent nozzles of group G3 are separated by two nozzles of group G1 and one from group G2 (not shown). Every pair of adjacent nozzles has the same magnitude of group time delay between them; a group time delay of $0.5\tau_o$ is shown. The breakoff time of drops from nozzles of group G1 lag behind the break off of drops from nozzles of group G3 by a group time delay of $0.5\tau_o$ and the breakoff time of drops from nozzles of G2 lag behind the break off time of nozzles of group G1 by $0.5\tau_o$. In the print mode shown in FIG. 8C all of the print drops in air labeled 1-7 have a $0.5\tau_o$ timing shift between adjacent drops and are again farther apart from each other than in the case of FIG. 8A. This further decreases charge to charge interactions on adjacent charged print drops resulting in less electrostatic repulsion between adjacent print drops. When printed on recording media 19 at half the maximum print speed this appears as ±one quarter image pixel offsets between adjacent printed image pixels along the nozzle array direction.

Figure 9B:
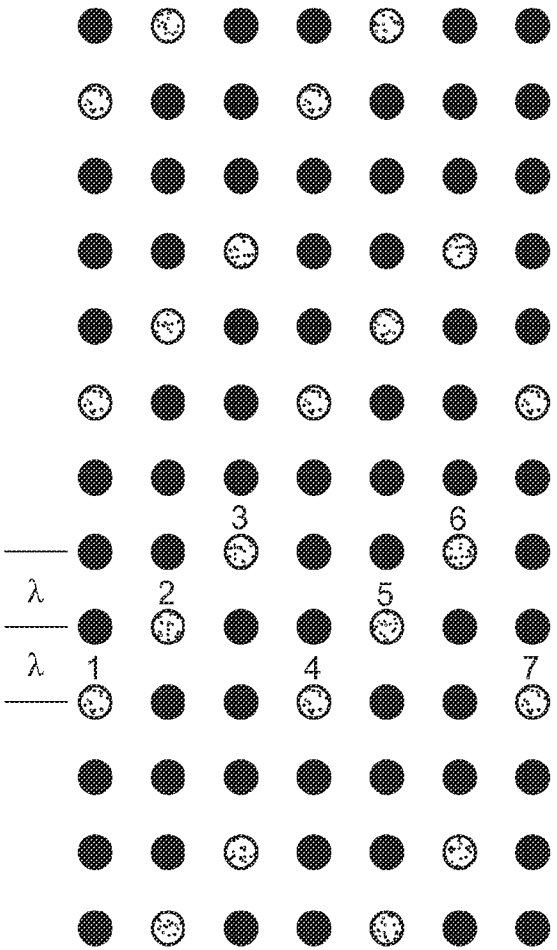
FIG. 9B shows a sequence of drops traveling in air from 7 adjacent nozzles before being deflected in which every fourth drop generated at the fundamental period is to be printed using a $1.0\tau_o$ or $2.0\tau_o$ timing shift between adjacent nozzles arranged into three nozzle groups according to an embodiment of this invention.
Figure 9A:
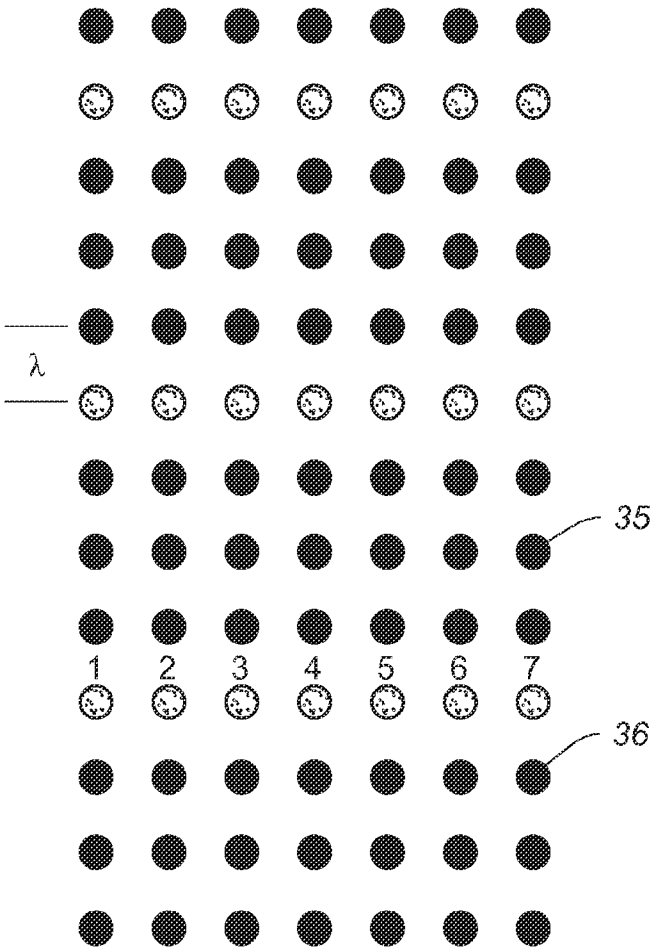
FIG. 9A shows a sequence of drops traveling in air from 7 adjacent nozzles before being deflected in which every fourth drop generated at the fundamental period is to be printed using no timing shift between nozzles in different groups.

FIGS. 9A-9B also show examples of an all drop print mode operating at one quarter maximum print speed. At this print speed, print drops aimed at consecutive pixels are separated by three non-print drops. FIG. 9A shows a sequence of drops traveling in air from 7 adjacent nozzles according to the prior art, having no timing shift between nozzles in different groups while FIG. 9B shows the same sequence of drops traveling in air from the same 7 adjacent nozzles in an embodiment of this invention using $1.0\tau_o$ and $2.0\tau_o$ timing shifts between pairs of adjacent nozzles arranged into three groups labeled G1, G2 and G3. In the print mode shown in FIG. 9A, print drops in air labeled 1 and 2, 2 and 3, 3 and 4, 4 and 5, 5 and 6 and 6 and 7 are adjacent to each other with the distance between them being equal to the nozzle spacing. In the print mode shown in FIG. 9B, print drops in air labeled 1 and 2, 2 and 3, 4 and 5, 5 and 6 have a $1.0\tau_o$ timing shift between them and are again farther apart from each other than in the case of FIG. 9A and print drops in air labeled 3 and 4 and 6 and 7 have a $2.0\tau_o$ timing shift between them causing them to be farther apart from each other than print drops in air labeled 1 and 2, 2 and 3, 4 and 5, 5 and 6 shown in FIG. 9A. This further decreases charge to charge interactions on adjacent charged print drops resulting in less electrostatic repulsion between adjacent print drops. When printed on recording media 19 at one quarter the maximum print speed, this appears as one quarter pixel and one half pixel offsets between adjacent printed image pixels along the nozzle array direction.

It is evident from the above discussion that the printer using two nozzle groups can be designed so that when drops impact the receiver there is a fixed image pixel offset between locations of printed drops created by the first nozzle group and the second nozzle group when viewed along a direction of receiver travel independent of receiver speed. As discussed above when printing at maximum printing speed as shown in FIG. 6B using a group timing delay of $0.5\tau_o$ between adjacent nozzles arranged into two groups results in a fixed offset of one half image pixel between locations of printed drops created by the first nozzle group and the second nozzle group when viewed along the direction of receiver travel. Also, printing at half maximum printing speed as shown in FIG. 7C using a group timing delay of $1.0\tau_o$ between adjacent nozzles arranged into two groups also results in a fixed offset of one half image pixel between locations of printed drops created by the first nozzle group and the second nozzle group when viewed along the direction of receiver travel. Similarly, a printer using three nozzle groups the printer can also be designed so that when drops impact the receiver there are fixed offsets between locations of printed drops created by the first nozzle group, the second nozzle group and the third nozzle group when viewed along a direction of receiver travel independent of receiver speed. Printing at half maximum printing speed as shown in FIG. 8B using three nozzle groups with $0.5\tau_o$ and $1.0\tau_o$ timing shifts between pairs of adjacent nozzles and printing at one quarter maximum printing speed as shown in FIG. 9B using three nozzle groups with $1.0\tau_o$ and $2.0\tau_o$ timing shifts between pairs of adjacent nozzles both result in fixed offsets of one quarter image pixel and one half image pixel between adjacent printed image pixels along the nozzle array direction. If the printing speed is decreased by a factor of m and the timing shifts between nozzle groups is increased by the same factor m then there is a fixed offset between locations of printed drops created by the different nozzle groups when viewed along a direction of receiver travel independent of the value of m. Thus the timing shift between adjacent nozzles can be adjusted with print speed so that there are fixed offsets between locations of printed drops created by nozzles in different nozzle groups when viewed along a direction of receiver travel independent of receiver speed. Such sub-pixel offsets are not objectionable to the eye when viewed in a normal context.

FIG. 10A and FIG. 10B show simulated images printed using the prior art and the method of this invention printed at a print density of 600 by 600 dpi respectively at ¼ maximum print speed. The image shown in FIG. 10A uses prior art methods without using a group timing delay between adjacent nozzles, while the image shown in FIG. 10B uses an embodiment of this invention using 2 nozzle groups with a group timing delay of $2\tau_o$ between adjacent nozzles. The vertical "T" is 33 pixels high and 27 pixels wide with a vertical trunk that is 5 pixels wide. The top of the vertical "T" is 2 pixels high and 27 pixels wide with asymmetrical edges extended downwards at the two edge of the top. The simulated print images shown in FIG. 10A and FIG. 10B were calculated using a charged particle dynamics model. As shown in FIG. 10A, it is observed that significant electrostatic repulsion occurs between nearby drops printed from adjacent nozzles without the use of shifting the timing of break off of print drops in adjacent nozzles. This causes printed lines in the recording media axis of motion to spread out from each other as compared to the ideal image. The top and bottom of the "T" are wider than in an ideal image and the vertical trunk is wider and gaps occur between adjacent vertical lines. The drop printed from the far most left printed nozzle of a row of print drops and the drop printed from the far most right printed nozzle of a row of print drops are separated from the rest of the drops in the row by a gap as a result of drop-drop interactions possible with the prior art. FIG. 10B, simulates the improved print quality obtained through the use of an embodiment of this invention, having a group timing delay between adjacent nozzles. In this case most of the defects observed in the prior art printing, without the use of a group timing delay between adjacent nozzles, are gone. Most of the spreading defects shown in FIG. 10A are gone as are the gaps between adjacent vertical lines. The image data shows that there is a half pixel offset between adjacent pixels along the vertical axis which is consistent with the expectations. When printed at normal size this half pixel offset is not objectionable to the viewer.

Although in the embodiments shown above print drops and non-print drops have essentially the same volume this invention can be practiced using print drops and non-print drops having different volumes as described by T. Yamada in U.S. Pat. No. 4,068,241, and B. Barbet in U.S. Pat. No. 7,712,879. In order to practice this invention with different volumes, the liquid is provided to the printhead at a pressure sufficient to eject liquid jets through a plurality of nozzles of a liquid chamber, the plurality of nozzles being disposed along a nozzle array direction, the plurality of nozzles being arranged into a first group and second group in which the nozzles of the first group and second group are interleaved such that a nozzle of the first group is positioned between adjacent nozzles of the second group and a nozzle of the second group is positioned between adjacent nozzles of the first group. A drop formation device associated with each of the plurality of nozzles is also provided. Input image data is provided, and each of the drop formation devices are provided with a sequence of drop formation waveforms to modulate the liquid jets to selectively cause portions of the liquid jets to break off into streams of one or more print drops having a print drop volume $V_p$ and one or more non-print drops having a non-print drop volume $V_{np}$ where the print drop volume and the non-print drop volume are distinct from each other in response to the input image data. A timing delay device is also provided to shift the timing of the drop formation waveforms supplied to the drop formation devices of nozzles of one of the first group or the second group so that the print drops formed from nozzles of the first group and the print drops formed from nozzles of the second group are not aligned relative to each other along the nozzle array direction. A charging device is also provided including: a first common charge electrode associated with the liquid jets formed from both the nozzles of the first group and the nozzles of the second group; and a source of constant electrical potential between the first charge electrode and the liquid jets. The first common charge electrode is positioned relative to the vicinity of break off of liquid jets to produce a print drop charge state on drops of volume $V_p$ and to produce a non-print drop charge state on drops of volume $V_{np}$ which is substantially different from the print drop charge state. A deflection device is provided to cause the print drops having the print drop charge state and the non-print drop having the non-print drop charge state to travel along different paths using the deflection device. A catcher is also provided to intercept non-print drops while allowing print drops to continue to travel along a path toward a receiver.

Figure 11:
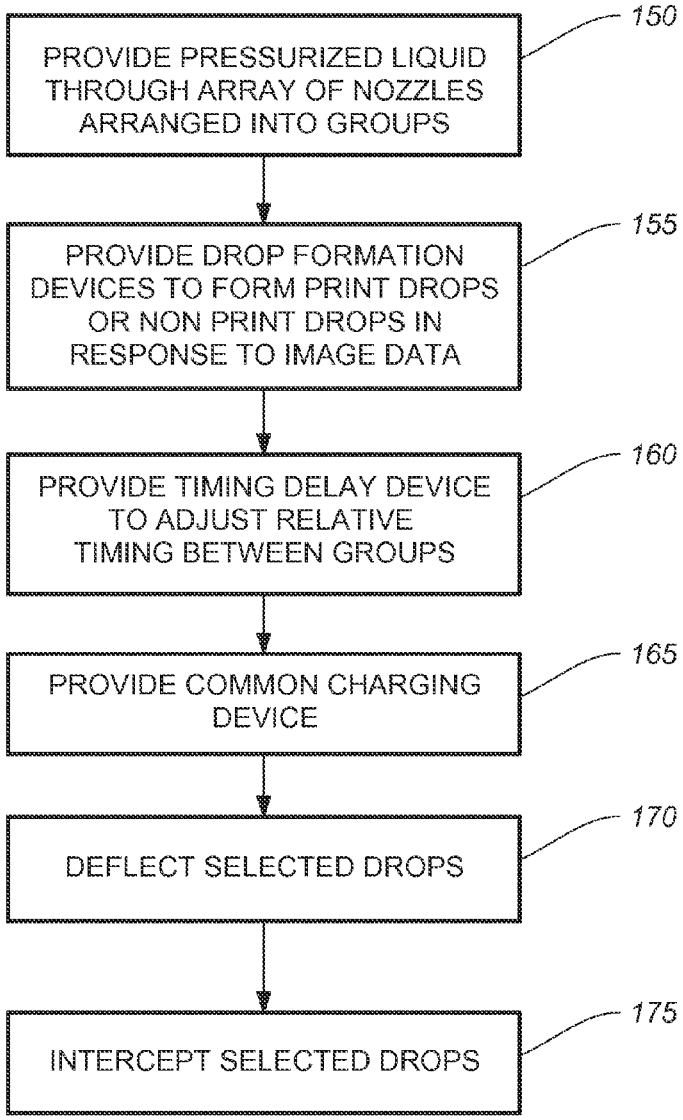
FIG. 11 shows a block diagram of the method of printing according to various embodiments of the invention.

FIG. 11 shows a block diagram outlining the steps required to practice the method of printing according to various embodiments of the invention. Referring to FIG. 11, the method of printing begins with step 150. In step 150, pressurized liquid is provided under a pressure that is sufficient to eject a liquid jet through a linear array of nozzles in a liquid chamber in which the nozzles are arranged into two or more groups of nozzles in which adjacent nozzles are in different groups. Step 150 is followed by step 155.

In step 155, the liquid jets are modulated by providing drop formation devices associated with each of the liquid jets with drop formation waveforms that cause portions of the liquid jets to break off into a series of print drops or non print drops in response to image data. The image data and the known recording media speed during printing are used to determine which drop formation waveform is applied to each of the drop formation devices in an array of nozzles as a function of time. The drop formation waveforms modulate the liquid jets to selectively cause portions of the liquid jets to break off into streams of one or more print drops having a jet breakoff length L in a print drop breakoff length range $L_p$ and one or more non-print drops having a jet breakoff length L' in a non-print drop breakoff length range $L_{np}$ where the print drop breakoff length range $L_p$ and the non-print drop breakoff length range $L_{np}$ are distinct from each other in response to the input image data. Step 155 is followed by step 160.

In step 160, a timing delay device is provided to adjust the relative breakoff timing between nozzles of different groups. This is a crucial step in the practice of this invention. It is to be noted that the timing delay device can be separate triggers with a time delay applied to the different groups as described in the discussion of FIG. 3 or it can be inherent in the waveforms applied to the nozzle array or it can be a provided by shifting of the input image data. Step 160 is followed by step 165.

In step 165, a common charging device is provided which is associated with the liquid jets. The common charging device includes a charge electrode and a charging voltage source. The common charging device is located adjacent to the liquid jets in order to produce a print drop charge state on print drops and a non-print drop charge states on non-print drops which are distinct from each other. Step 165 is followed by step 170.

In step 170, print and non-print drops are differentially deflected. An electrostatic deflection device is used to cause print drops to travel along a path distinct from paths of the non print drops to travel along a second path. The deflection device may include the charge electrode, bias electrodes, catchers and other components. Step 175 is followed by step 180.

In step 175, non-print drops are intercepted by a catcher for recycling and print drops are not intercepted by the catcher and allowed to contact the recording media and are printed.

Generally this invention can be practiced to create print drops in the range of 1-100 pl, with nozzle diameters in the range of 5-50 μm, depending on the resolution requirements for the printed image. The jet velocity is preferably in the range of 10-30 m/s. The fundamental drop generation frequency is preferably in the range of 50-1000 kHz.

The invention allows drops to be selected for printing or non-printing without the need for a separate charge electrode to be used for each liquid jet in an array of liquid jets as found in conventional electrostatic deflection based ink jet printers. Instead a single common charge electrode is utilized to charge drops from the liquid jets in an array. This eliminates the need to critically align each of the charge electrodes with the nozzles. Crosstalk charging of drops from one liquid jet by means of a charging electrode associated with a different liquid jet is not an issue. Since crosstalk charging is not an issue, it is not necessary to minimize the distance between the charge electrodes and the liquid jets as is required for traditional drop charging systems. The common charge electrode also offers improved charging and deflection efficiency thereby allowing a larger separation distance between the jets and the electrode. Distances between the charge electrode and the jet axis in the range of 25-300 μm are useable. The elimination of the individual charge electrode for each liquid jet also allows for higher densities of nozzles than traditional electrostatic deflection continuous inkjet system, which require separate charge electrodes for each nozzle. Arranging the nozzles into groups so that no adjacent nozzles are in the same group and providing a time delay device to shift the timing of the drop formation waveforms supplied to the various nozzle groups ensures that the print drops formed from nozzles of the various groups are not aligned with each other along the nozzle array direction decreases electrostatic interactions between adjacent print drops which results in less drop placement errors. The nozzle array density can be in the range of 75 nozzles per inch (npi) to 1200 npi.

The invention has been described in detail with particular reference to certain example embodiments thereof, but it will be understood that variations and modifications can be effected within the scope of the invention.

PARTS LIST

10 Continuous Inkjet Printing System
11 Ink Reservoir
12 Printhead or Liquid Ejector
13 Image Source
14 Deflection Mechanism
15 Ink Recycling Unit
16 Image Processor
17 Logic Controller
18 Stimulation controller
19 Recording media
20 Ink Pressure Regulator
21 Media Transport Controller
22 Transport Rollers
24 Liquid Chamber
26 Non-Print Drop Catcher Contact Location
30 Catcher Ledge
32 Breakoff Location
35 Print Drop
36 Non-Print Drop
37 Print Drop Path
38 Non-Print Drop Path
40 Continuous Liquid Ejection System
42 Nozzle Orifice Plane
43 Liquid Jet
44 Charge electrode
44A Symmetric Charge Electrode
44$_F$ Front Surface of Charge Electrode
45 Optional Second Charge Electrode
46 Printed Ink Drop
47 Catcher
48 Ink Film
49 Optional Charging Voltage Source
50 Nozzle
51 Charging Voltage Source
51A Charging Voltage Source
52 Catcher Face
53 Deflection Electrode
55 Stimulation Waveform
56 Stimulation Waveform Source
57 Catcher Bottom Plate
58 Ink Recovery Channel
59 Drop Formation Transducer
63 Deflection Electrode
67 Catcher
76 First Group trigger
77 Second Group trigger
78 Group Timing Delay Device
83 Charging Device
87 Liquid Jet Axis
89 Drop Formation Device
150 Provide pressurized liquid through nozzle step
155 Provide drop formation device step
160 Provide timing delay device step
165 Provide common charging device step
170 Deflects selected drops step
175 Intercept selected drops step

The invention claimed is:

1. A method of printing comprising;

providing liquid under pressure sufficient to eject liquid jets through a plurality of nozzles of a liquid chamber, the plurality of nozzles being disposed along a nozzle array direction, the plurality of nozzles being arranged into a first group and second group in which the nozzles of the first group and second group are interleaved such that a nozzle of the first group is positioned between adjacent nozzles of the second group and a nozzle of the second group is positioned between adjacent nozzles of the first group;

providing a drop formation device associated with each of the plurality of nozzles;

providing input image data;

providing each of the drop formation devices with a sequence of drop formation waveforms to modulate the liquid jets to selectively cause portions of the liquid jets to break off into streams of one or more print drops having a print drop volume $V_p$ and one or more non-print drops having a non-print drop volume $V_{np}$ where the print drop volume and the non-print drop volume are distinct from each other in response to the input image data;

providing a timing delay device to shift the timing of the drop formation waveforms supplied to the drop formation devices of nozzles of one of the first group or the second group so that the print drops formed from nozzles of the first group and the print drops formed from nozzles of the second group are not aligned relative to each other along the nozzle array direction;

providing a charging device including:

a first common charge electrode associated with the liquid jets formed from both the nozzles of the first group and the nozzles of the second group; and a source of constant electrical potential between the first charge electrode and the liquid jets;

the first common charge electrode being positioned relative to the vicinity of break off of liquid jets to produce a print drop charge state on drops of volume $V_p$ and to produce a non-print drop charge state on drops of volume $V_{np}$ which is substantially different from the print drop charge state;

providing a deflection device;

causing print drops having the print drop charge state and non-print drop having the non-print drop charge state to travel along different paths using the deflection device;

providing a catcher; and intercepting non-print drops using the catcher while allowing print drops to continue to travel along a path toward a recording media.

2. The method of claim 1, the plurality of nozzles being arranged in a third nozzle group, nozzles of the third group being interleaved with nozzles of the first group and nozzles of the second group, wherein providing the timing delay device includes providing a timing delay device that is configured to shift the timing of the drop formation waveforms of the third group relative to the first group and the second group so that the print drops formed from nozzles of the first group, the print drops formed from nozzles of the second group and the print drops formed from nozzles of the third group are not aligned relative to each other along the nozzle array direction.

3. The method of claim 2, the print drops having impacted the recording media, wherein the timing shift between the first nozzle group and the second nozzle group, the second nozzle group and the third nozzle group and the third nozzle group and the first nozzle group is recording media speed dependent and results in fixed shifts between locations of printed drops created by the first nozzle group, the second nozzle group and the third nozzle group when viewed along a direction of recording media travel independent of recording media speed.

4. The method of claim 2, wherein providing a timing delay device to shift the timing of the drop formation waveforms supplied to the drop formation devices of nozzles of one of the first group or the second group also includes providing a timing delay device to the third group so that the print drops formed from nozzles of the first group, the print drops formed from nozzles of the second group and the print drops formed from nozzles of the third group are not aligned relative to each other along the nozzle array direction.

5. The method of claim 4, wherein the timing delay between nozzles of the first group and nozzles of the second group is the same as the timing delay between nozzles of the second group and nozzles of the third group.

6. The method of claim 1, wherein the drop formation device comprises a drop formation transducer associated with each of the nozzles, wherein the drop formation transducer is one of a thermal device, a piezoelectric device, a MEMS actuator, an electrohydrodynamic device, a dielectrophoresis modulator, an optical device, an electrostrictive device, and combinations thereof.

7. The method of claim 1, wherein the deflection device further comprises a deflection electrode in electrical communication with a source of electrical potential that creates a drop deflection field to deflect charged drops.

8. The method of claim 1, wherein the plurality of nozzles, the drop formation devices and the timing devices are formed on a single MEMS CMOS chip.

9. The method of claim 1, wherein every print drop produced by a single jet is preceded and followed by a non-print drop.

10. The method of claim 1, the print drops having impacted the recording media, wherein the timing shift between the first nozzle group and the second nozzle group is dependent on a recording media speed relative to the printhead and results in a fixed offset between locations of printed drops created by the first nozzle group and the second nozzle group when viewed along a direction of recording media travel independent of recording media speed.

11. The method of claim 1, wherein alternate adjacent nozzles of the second group form a third group wherein providing a timing delay device to shift the timing of the drop formation waveforms supplied to the drop formation devices of nozzles of one of the first group or the second group also includes providing a timing delay device to the third group so that the print drops formed from nozzles of the first group, the print drops formed from nozzles of the second group and the print drops formed from nozzles of the third group are not aligned relative to each other along the nozzle array direction.

12. The method of claim 11, wherein the timing delay between nozzles of the first group and nozzles of the second group has the same magnitude as the timing delay between nozzles of the first group and nozzles of the third group.

* * * * *

UNITED STATES PATENT AND TRADEMARK OFFICE

CERTIFICATE OF CORRECTION

PATENT NO. : 8,646,883 B2
APPLICATION NO. : 13/424436
DATED : February 11, 2014
INVENTOR(S) : Michael A. Marcus et al.

It is certified that error appears in the above-identified patent and that said Letters Patent is hereby corrected as shown below:

In the Drawings

| | |
|---|---|
| FIG. 6B Sheet 12 of 18 | Delete "(Prior Art)" |
| FIG. 7B Sheet 13 of 18 | Delete "(Prior Art)" |
| FIG. 7C Sheet 13 of 18 | Delete "(Prior Art)" |
| FIG. 8B Sheet 14 of 18 | Delete "(Prior Art)" |
| FIG. 9A Sheet 16 of 18 | Below "FIG 9A", Insert --(Prior Art)-- |

Signed and Sealed this
Twenty-third Day of September, 2014

Michelle K. Lee

Michelle K. Lee
*Deputy Director of the United States Patent and Trademark Office*